US011167219B2

(12) United States Patent
Christensen et al.

(10) Patent No.: US 11,167,219 B2
(45) Date of Patent: Nov. 9, 2021

(54) MULTI-POSITION BODY MOUNT FOR MODEL VEHICLE

(71) Applicant: TRAXXAS LP, McKinney, TX (US)

(72) Inventors: Casey Christen Jens Christensen, McKinney, TX (US); Roy Perryman, Conroe, TX (US); Otto Karl Allmendinger, Rowlett, TX (US)

(73) Assignee: TRAXXAS LP, McKinney, TX (US)

( * ) Notice: Subject to any disclaimer, the term of this patent is extended or adjusted under 35 U.S.C. 154(b) by 0 days.

(21) Appl. No.: 16/479,538

(22) PCT Filed: Jan. 19, 2018

(86) PCT No.: PCT/US2018/014555
§ 371 (c)(1),
(2) Date: Jul. 19, 2019

(87) PCT Pub. No.: WO2018/136813
PCT Pub. Date: Jul. 26, 2018

(65) Prior Publication Data

US 2019/0381416 A1 Dec. 19, 2019

Related U.S. Application Data

(60) Provisional application No. 62/448,011, filed on Jan. 19, 2017.

(51) Int. Cl.
*A63H 17/26* (2006.01)

(52) U.S. Cl.
CPC ..... *A63H 17/262* (2013.01)

(58) Field of Classification Search
CPC ... A63H 17/002; A63H 17/262; A63H 17/264
(Continued)

(56) References Cited

U.S. PATENT DOCUMENTS 1,600,835 A * 9/1926 Manley ..... B25H 1/0007 269/46
4,586,359 A * 5/1986 Parks ..... B21D 1/14 269/71

(Continued)

FOREIGN PATENT DOCUMENTS

AT 507807 A1 8/2010
CN 202199110 U 4/2012

(Continued)

OTHER PUBLICATIONS

International Search Report, by the ISA/KR, dated May 30, 2018, re PCT/US2018/014555.

(Continued)

*Primary Examiner* — Joseph B Baldori
(74) *Attorney, Agent, or Firm* — Daryl R. Wright; Greg Carr

(57) ABSTRACT

A body mount system and method for a model vehicle that includes a vertically adjustable body post and a body slide that can be attached to the body post in a fixed configuration and a movable configuration. The body mount system further includes a first and second body post cap removably attached to either end of the body slide in a fixed configuration and movable configuration. The first and second body post caps include respective first and second body supports rotatively attached to the first and second body post caps. Wherein the movable body slide configuration permits adjustment of the body slide in a first horizontal direction relative to the body post and wherein the movable first and second body post cap configurations permit adjustments to the first and second body post caps in a second horizontal direction relative to the body slide.

13 Claims, 23 Drawing Sheets

(58) Field of Classification Search
USPC ..... 446/465, 469, 470, 471
See application file for complete search history.

(56) References Cited

U.S. PATENT DOCUMENTS

| | | | | |
|---|---|---|---|---|
| 4,804,162 | A * | 2/1989 | Rice | B25H 1/0007 248/129 |
| 4,949,944 | A * | 8/1990 | Groff, Sr. | B25B 5/003 269/296 |
| 5,197,393 | A * | 3/1993 | Yeakle | A47B 9/10 108/10 |
| 5,556,064 | A * | 9/1996 | Cowe | F16M 11/24 248/172 |
| 6,582,275 | B1 | 6/2003 | Lai | |
| 7,237,758 | B2 * | 7/2007 | Nikolic | B25H 1/0007 248/127 |
| 7,377,502 | B2 * | 5/2008 | Nikolic | B25H 1/0007 269/17 |
| 7,448,606 | B1 * | 11/2008 | Johnson | B05B 13/0285 269/16 |
| 8,245,856 | B1 * | 8/2012 | Pappin | A63H 17/44 211/13.1 |
| 10,689,124 | B2 * | 6/2020 | Martin | A63H 27/02 |
| 10,744,526 | B2 * | 8/2020 | Johnson | B05B 13/0285 |
| 2005/0112986 | A1 | 5/2005 | Arlton | |
| 2006/0261613 | A1 * | 11/2006 | Byers | B60R 19/28 293/135 |
| 2012/0242022 | A1 * | 9/2012 | Gagnon, Jr. | B25B 11/00 269/9 |

FOREIGN PATENT DOCUMENTS

| | | | |
|---|---|---|---|
| JP | H10-085464 | A | 4/1998 |
| JP | 2004-073444 | A | 3/2004 |
| WO | 2011007460 | A1 | 1/2011 |

OTHER PUBLICATIONS

Written Opinion, by the ISA/KR, dated May 30, 2018, re PCT/US2018/014555.
European Search Report; European Patent Application No. EP 18741834; dated Sep. 18, 2020.

* cited by examiner

MULTI-POSITION BODY MOUNT FOR MODEL VEHICLE

RELATED APPLICATIONS

This application is a National Stage Entry of PCT/US18/1455, filed Jan. 19, 2018, entitled "MULTI-POSITION BODY MOUNT FOR MODEL VEHICLE," to Casey Christen Jens CHRISTENSEN, et al., which claims the benefit of a related U.S. Provisional Application Ser. No. 62/448,011, filed Jan. 19, 2017, entitled "MULTI-POSITION BODY MOUNT FOR MODEL VEHICLE," to Casey Christen Jens CHRISTENSEN, et al., which the disclosure of both of which are incorporated by reference herein in their entirety.

BACKGROUND OF THE INVENTION

Field of the Invention

The present invention relates to remote controlled model vehicles and, more particularly, to a method and apparatus for mounting a model vehicle body to a vehicle platform.

Description of the Related Art

Vehicle bodies for remote controlled vehicles may vary with different designs, shapes, and sizes. Traditionally, variations in vehicle bodies require a unique and different body mounting system for each of the various vehicle bodies to be mounted on the same vehicle platform. Therefore, a vehicle body mounting system capable of allowing various adjustments of the body mount in three dimensions is desirable and may refine body fitment of multiple different vehicles body on a single vehicle platform.

SUMMARY

A body mount system for a model vehicle comprising a body post attachable to a model vehicle platform including a plurality of vertical mounting locations and a body slide removably attachable to the body post in a fixed body slide configuration and a movable body slide configuration. The body mount system further includes a first body post cap removably attachable to one end of the body slide in a fixed first body post cap configuration and a movable first body post cap configuration, wherein the first body post cap includes a first body support rotatively coupled to the first body post cap and a second body post cap removably attachable to another end of the body slide in a fixed second body post cap configuration and a movable second body post cap configuration, where the second body post cap includes a second body support rotatively coupled to the second body post cap. Wherein the movable body slide configuration permits adjustment of the body slide in a first horizontal direction relative to the body post and wherein the movable first and second body post cap configurations permit adjustments to the first and second body post caps in a second horizontal direction relative to the body slide.

A method for mounting a model vehicle body comprising attaching a body post relative to a model vehicle platform and attaching a body slide to the body post in a fixed or movable body slide configuration. The method further includes attaching a first body post cap to one end of the body slide in a fixed or movable first body post cap configuration and attaching a second body post cap to another end of the body slide in a fixed or movable second body post cap configuration. In addition, the method includes adjusting the body post vertically to correspond to mounting locations of the model vehicle body. Wherein the body slide is mounted in the fixed body slide configuration for standard model vehicle body mounting locations and in the movable body slide configuration for non-standard model vehicle body mounting locations and wherein the first and second body post caps are mounted in the fixed first and second body post cap configurations for standard model vehicle body mounting locations and in the movable first and second body post cap configurations for non-standard model vehicle body mounting locations.

BRIEF DESCRIPTION OF DRAWINGS

Reference is now made to the following Detailed Description taken in conjunction with the accompanying drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, specific details, and the like, have been omitted inasmuch as such details are not considered necessary to obtain a complete understanding of the present invention, and are considered to be within the understanding of persons of ordinary skill in the relevant art.

Multi-position body mounting systems have traditionally allowed movement of the body mount in all three axis directions (X, Y, Z). However, each of the varied positions in the X and Y directions were fixed and did not allow for specific fine adjustments and movements of the mounts in any one direction only. Furthermore, a body mounting system using multiple fixed locations for mounting a vehicle body would not be able to account for mis-drilled body holes in the vehicle body.

Figure 1:
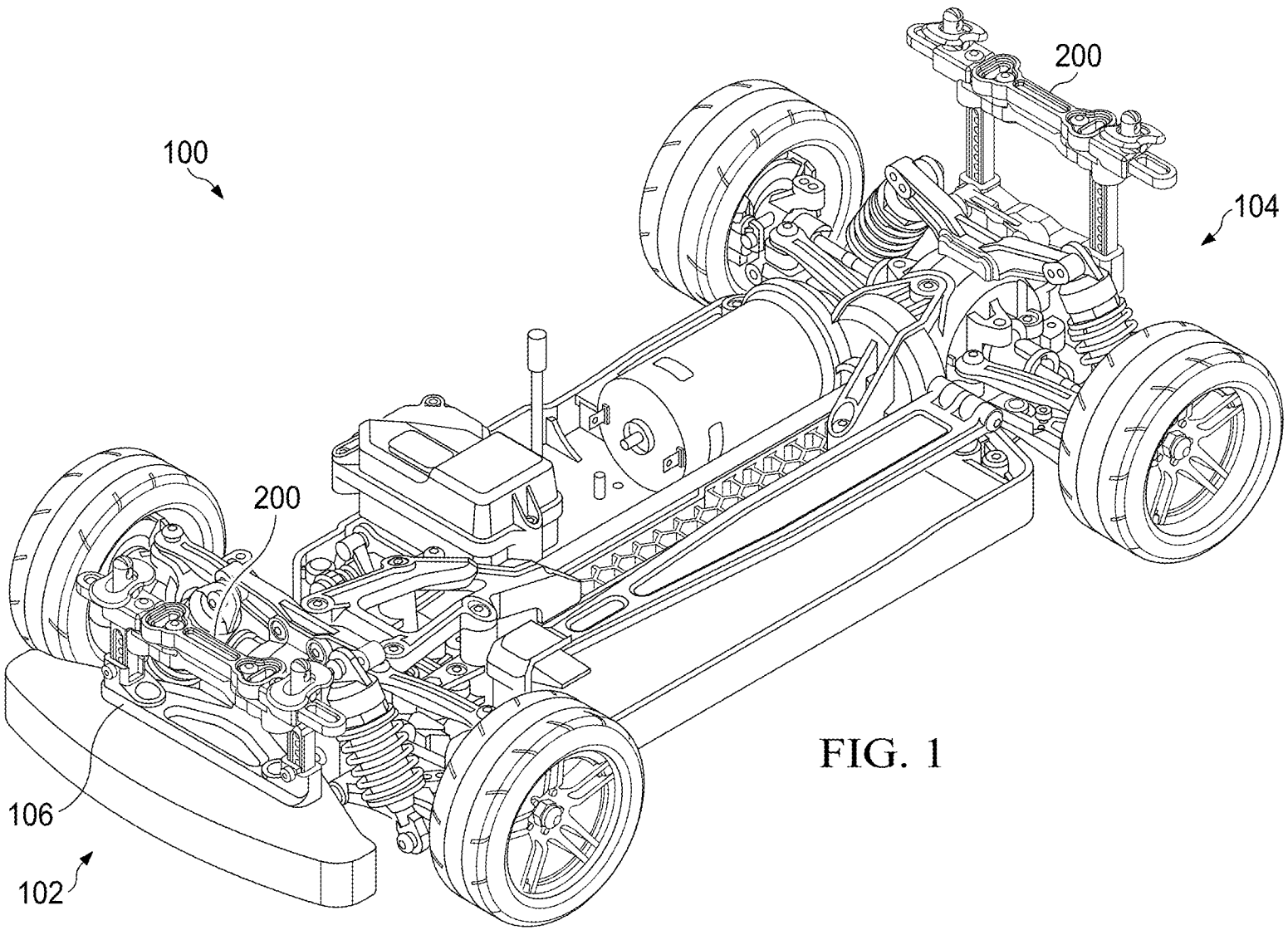
FIGS. 1-3 show a perspective, a top, and a side view of a body mount on a front portion and a rear portion of a vehicle platform.
Figure 2:
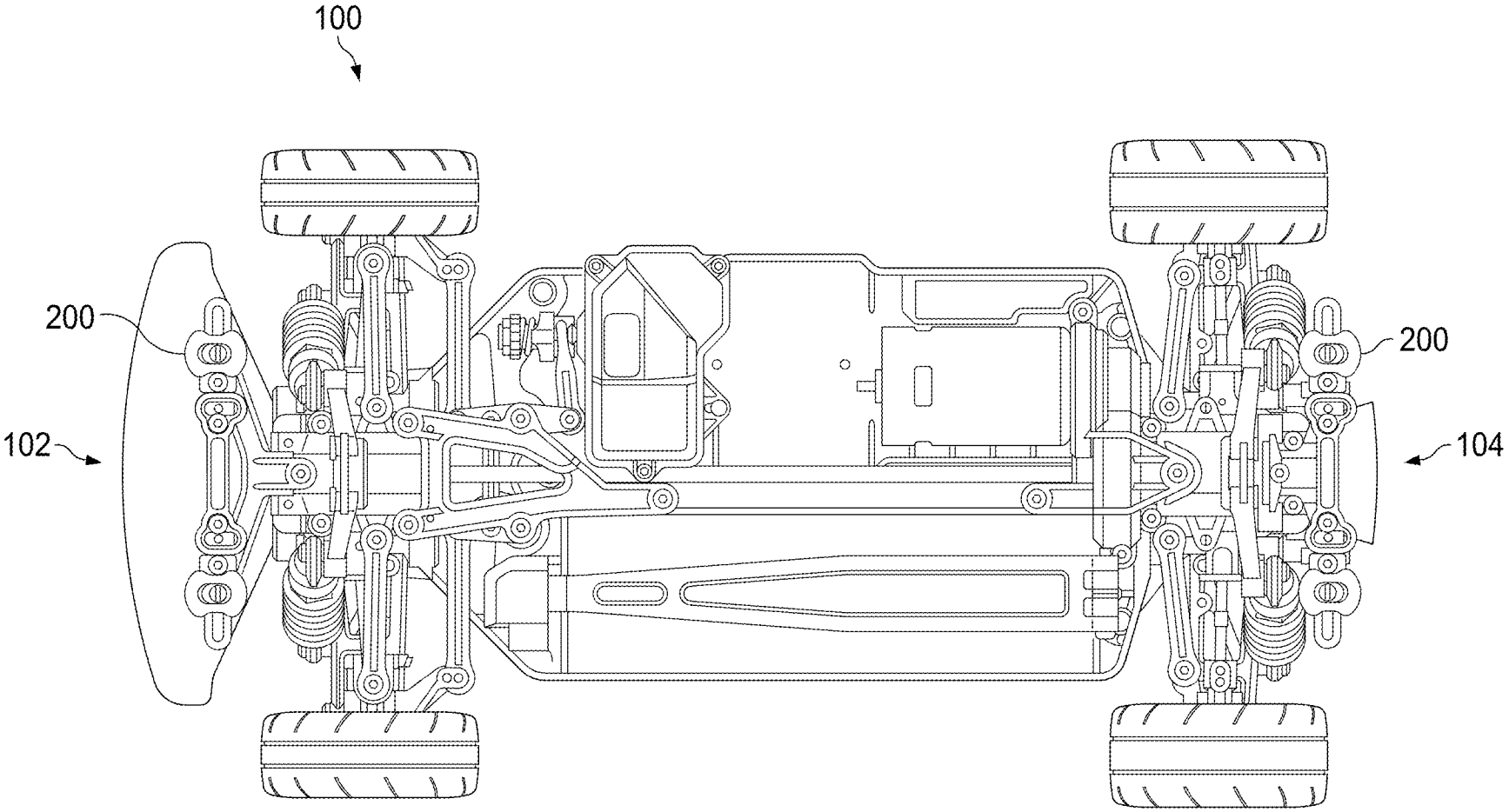
Figure 3:
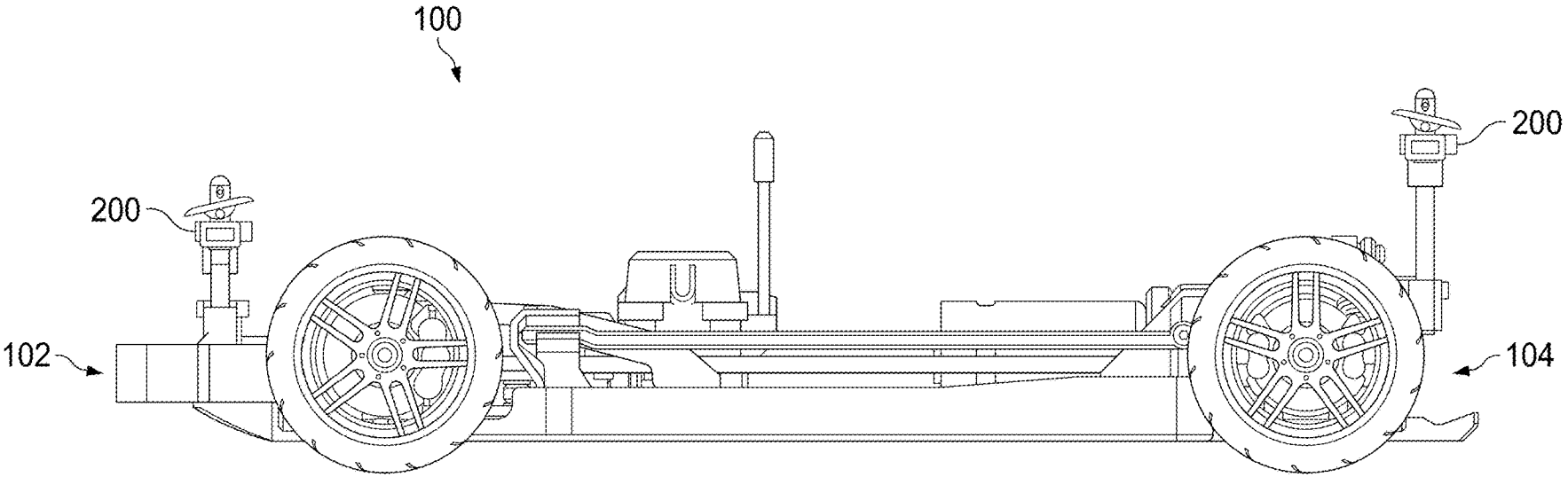

FIGS. 1-3 illustrate a vehicle platform 100 with a body mount 200 secured to a front portion 102 and a rear portion 104 of the platform 100. At least one body mount 200 may be used to mount a vehicle body to the vehicle platform 100. In the embodiment shown, the body mount 200 may be secured to the front portion 102 of the vehicle platform 100 to mount a front portion of a vehicle body. A second body mount 200 may also be secured to the rear portion 104 of the platform 100 to mount a rear portion of the vehicle body to the platform 100. Alternatively, depending on the design of the vehicle platform 100 and the vehicle body, at least one body mount 200 may be secured to other portions of the vehicle platform 100 to mount the vehicle body to the platform 100.

Figure 4A:
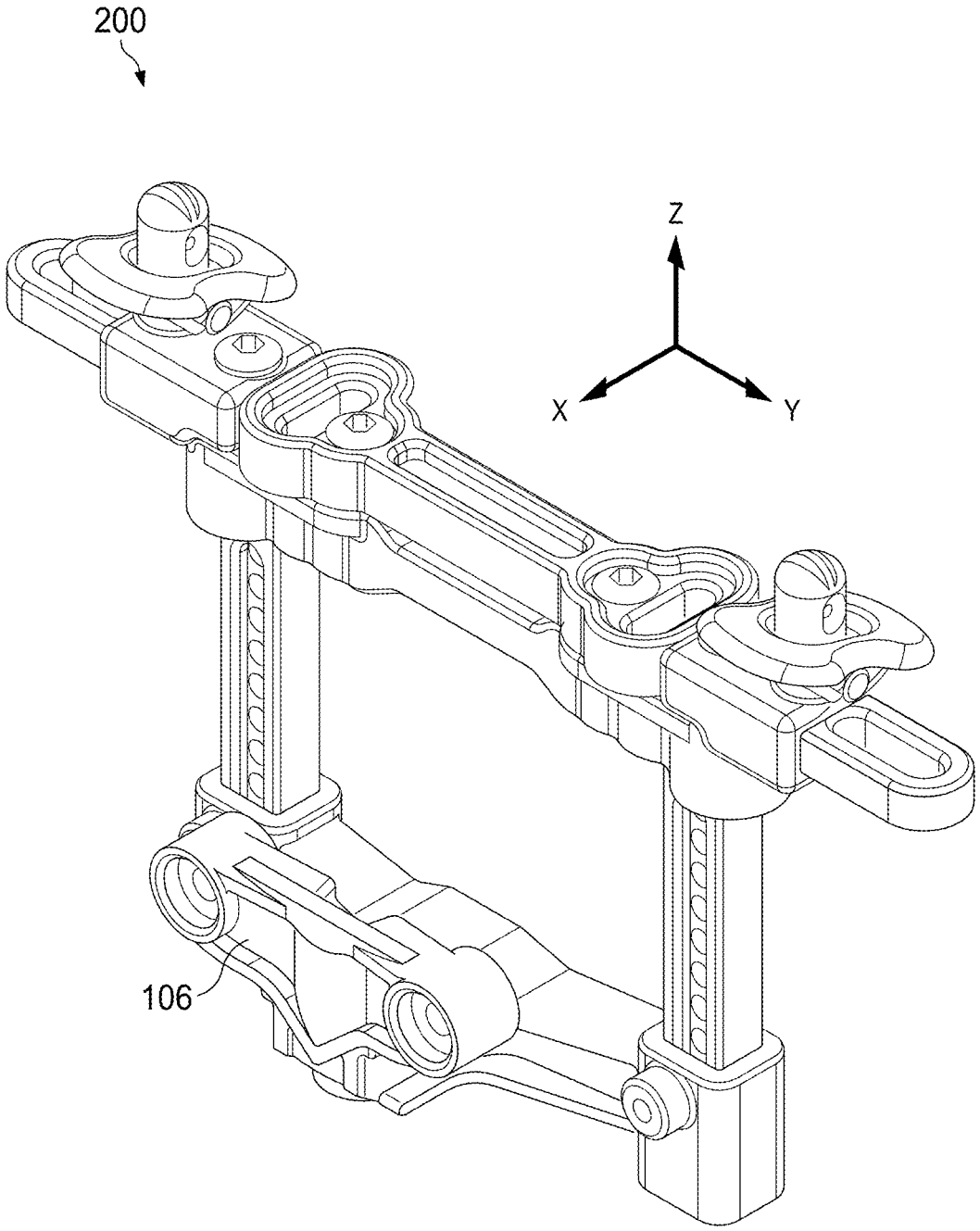
FIG. 4A shows a perspective view of the body mount and a body mount retainer.
Figure 4B:
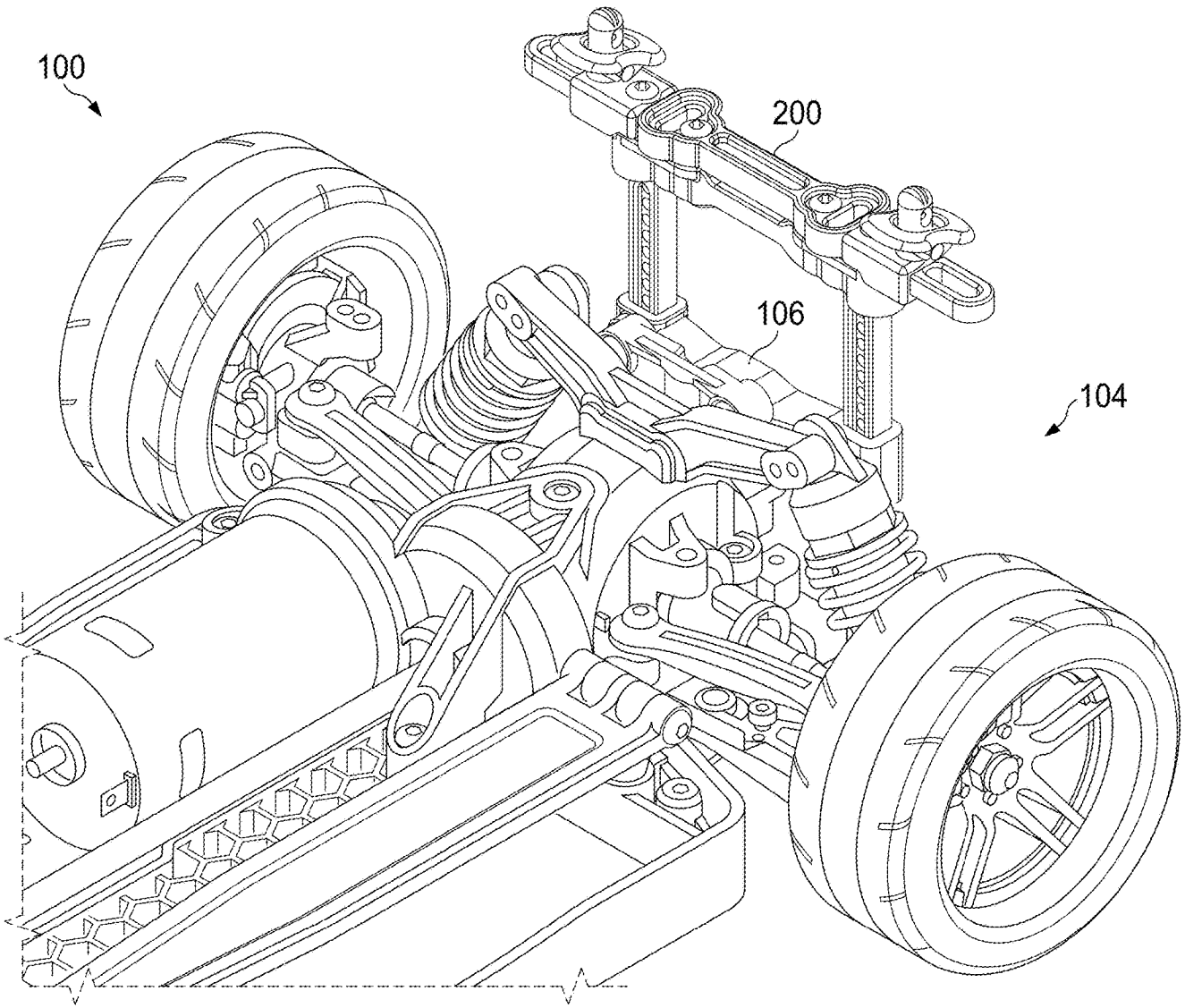
FIG. 4B shows the body mount and body mount retainer as used on the rear portion of the vehicle platform

Turning to FIGS. 4A and 4B, the body mount 200 may be secured to the vehicle platform 100 using a body mount retainer 106. In the example shown, the body retainer 106 may be configured for securing the body mount 200 to the rear portion of the vehicle platform 100 as shown in FIG. 4B. The body mount retainer 106 may be alternatively configured depending on the desired placement of the body mount 200 on the vehicle platform 100.

Figure 5:
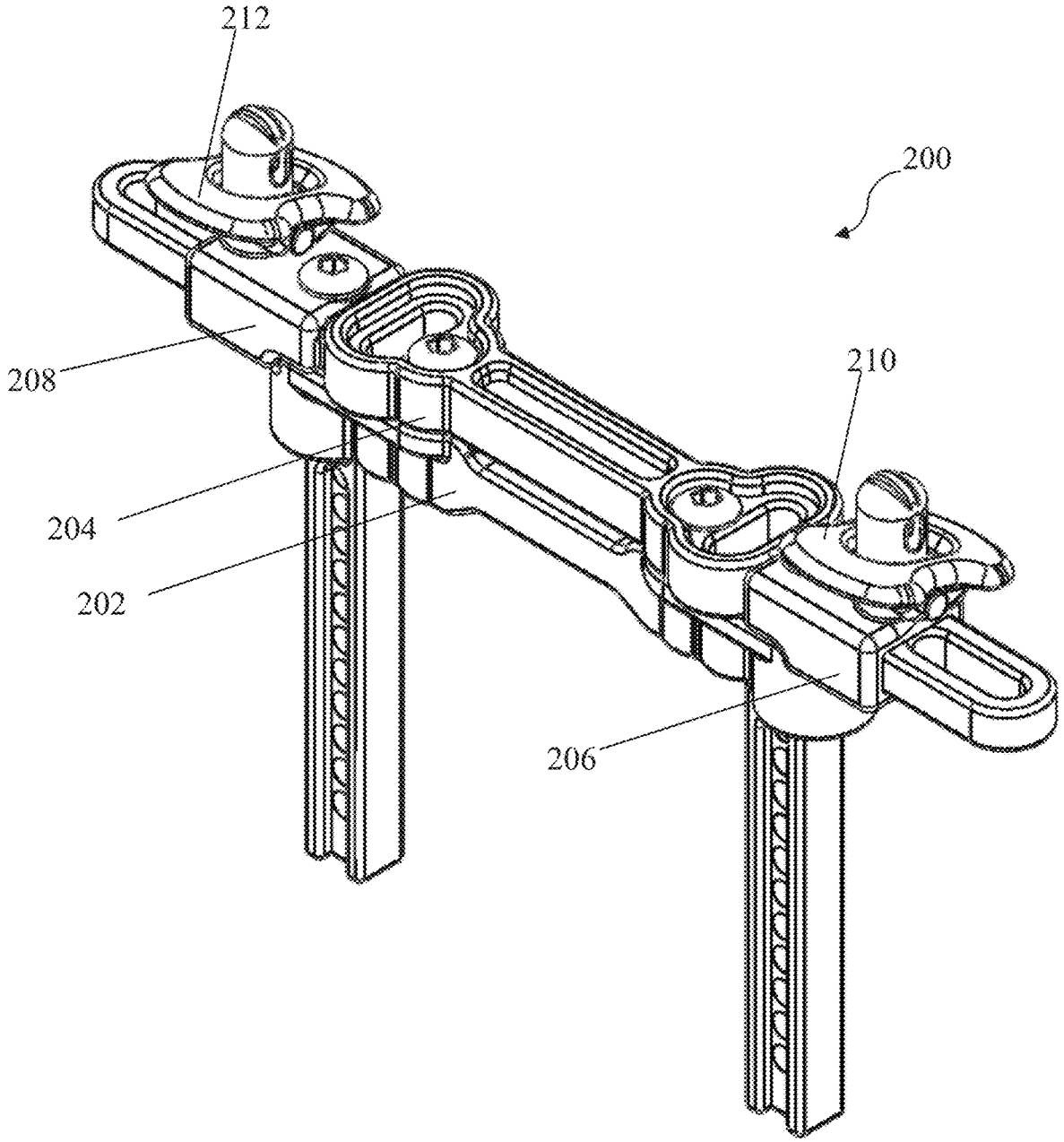
FIG. 5 shows a perspective view of the body mount in a fixed configuration.

Turning to FIG. 5, an exemplary embodiment of the body mount 200 is shown. The body mount 200 may comprise a body post 202, a body post slide 204, a first body post cap 206, a second body post cap 208, a first body support 210, and a second body support 212. Each of the body mount 200 may comprise at least two individual mounts for supporting the vehicle body. In the example shown in FIG. 5, the first body support 210 and the second body support 212 may make up the two individual mounts in the body mount 200. In the example shown in FIGS. 1-3, the two body mounts 200 used on both the front portion 102 and the rear portion 104 of vehicle platform 100 may equip the vehicle platform 100 with a total of four individual mounts for supporting the vehicle body.

When mounting the vehicle body using the body mount 200, the body mount 200 may be configured by a user between a "fixed" configuration and a "movable" configuration prior to the mounting. As shown in FIG. 4A, when the body mount 200 is in the "fixed" configuration, fasteners may be installed such that the first and second body post caps 206, 208 and the body post slide 204 may not move or be adjusted in the X and Y directions independent of the body post 202. However, the body post 202 secured by the body mount retainer 106 may still allow for the height adjustment of the body mount 200 and therefore movement of the body post caps 206, 208 and the body post slide 204 in the Z direction. The "fixed" configuration may also be used as a stock configuration for the body mount 200 for ease of assembly, packaging, and shipping.

Alternatively, the body mount 200 may be readjusted and the fasteners installed such that the body mount 200 is configured to the "movable" configuration. When this alternative configuration is used, the first and second body post caps 206, 208 and the body post slide 204 may move in the X and Y directions independent of the body post 204 held by the body mount retainer 106. When mounting the vehicle body using the body mount 200 in the "movable" configuration, the user may finely adjust the X and Y position of the first and second body supports 210, 212 such that they may better align with the vehicle body being mounted.

Figure 6:
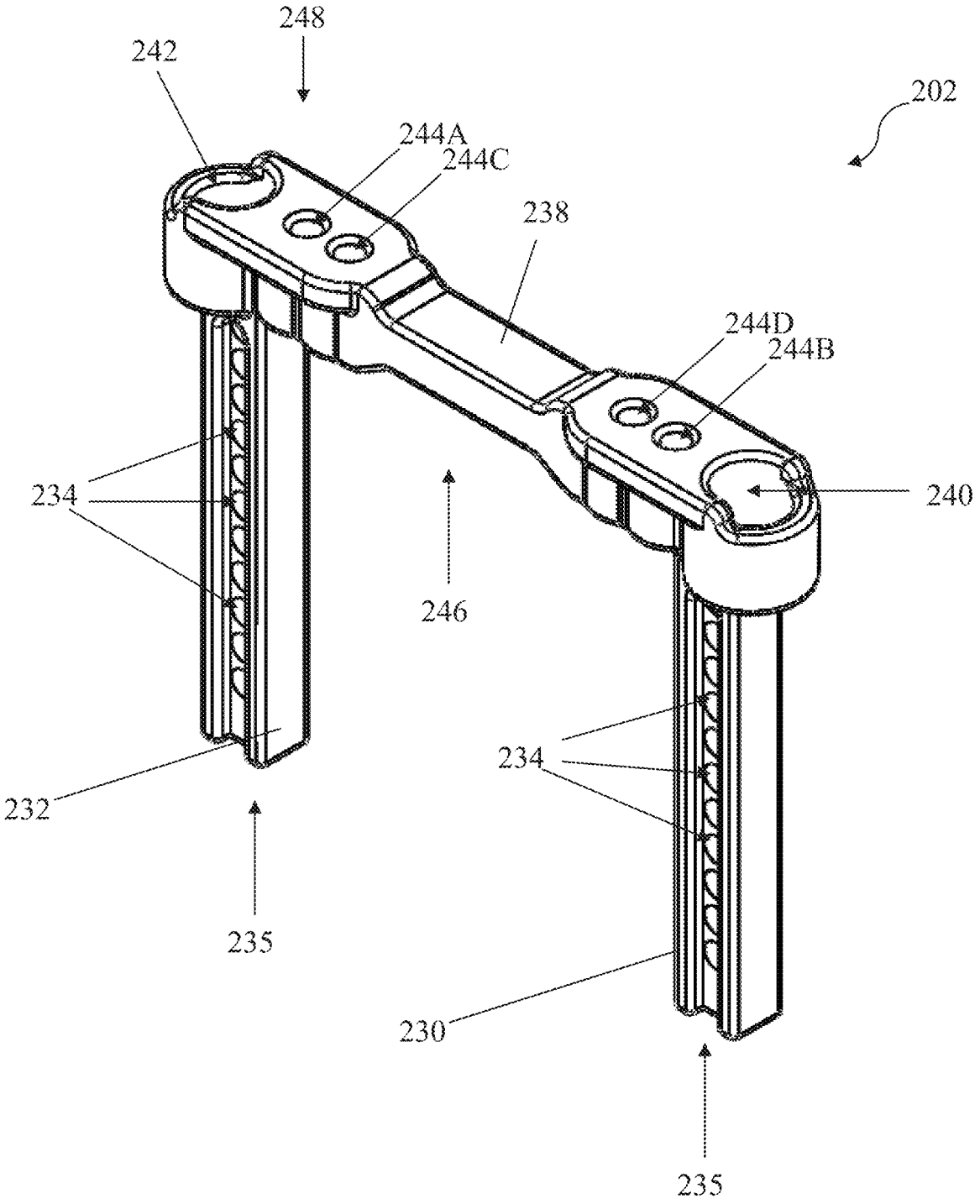
FIG. 6 shows a perspective view of a body post.
Figure 7A:
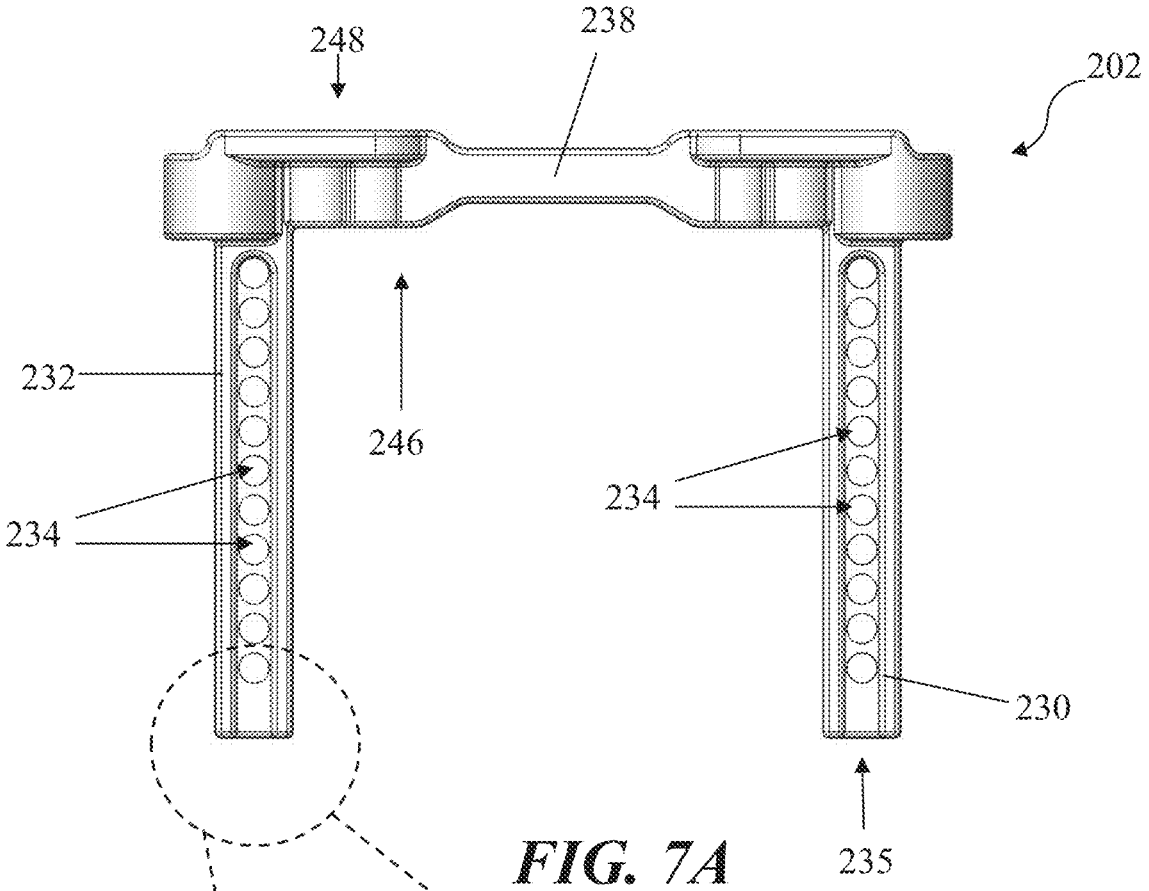
FIG. 7A shows a front view of the body post.
Figure 7B:
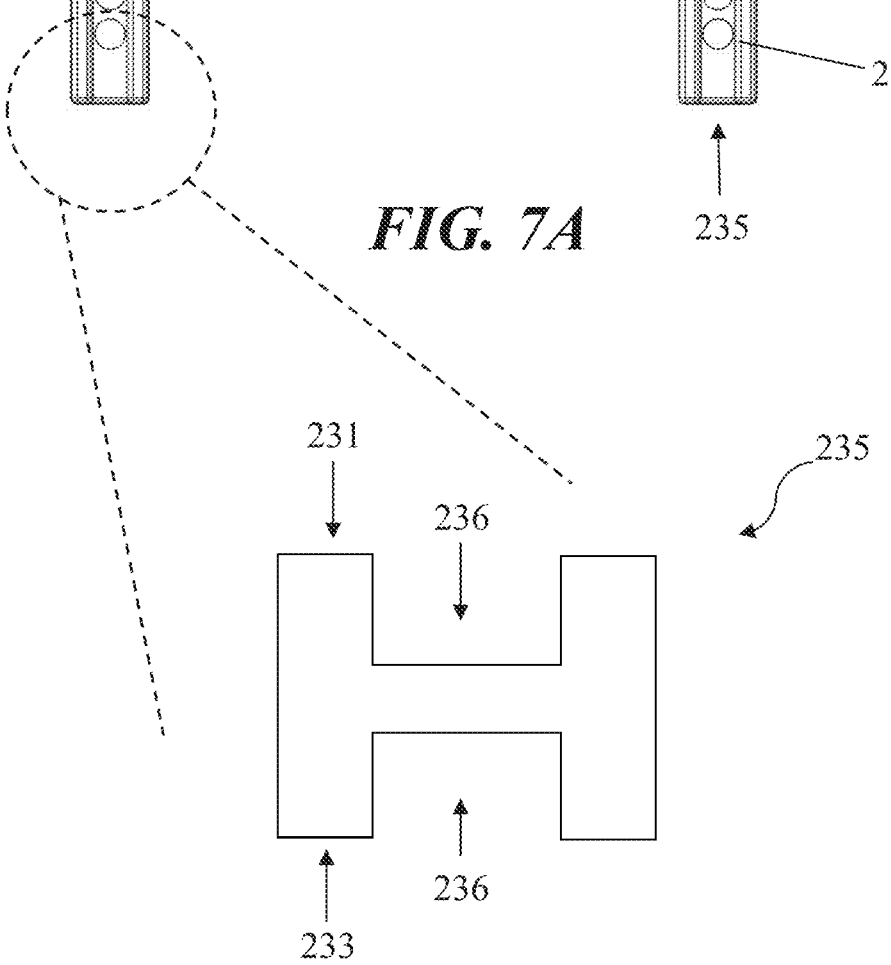
FIG. 7B shows a close up of an end view of a vertical post member of the body post.

Turning to FIGS. 6 and 7A-7B, the body post 202 may be configured to provide height adjustments for the body mount 200. The body post 202 may allow for the movement of the first and second body supports 210, 212 in the Z direction relative to the vehicle platform 100. The body post 202 may be formed in the shape of an arch comprising a first vertical post members 230, a second vertical post member 232, and a horizontal post member 238. The horizontal post member 238 may extend from and connect the ends of the two vertical post members 230, 232. The two vertical post members 230, 232 may contact a bottom surface 246 of the horizontal post member 238. The vertical members 230, 232 may be configured to allow for height adjustment of the body mount 200. The horizontal post member 238 may be configured to support the rest of the body mount 200.

Each of the vertical post members 230, 232 may comprise a channel cutout 236 extending across two surfaces of the member 230, 232. The channel cutouts 236 may begin from a free end 235 of each the members 230, 232 and extend across the body of the members 230, 232 just right before contacting the horizontal supporting member 238. The channel cutout 236 may be formed in both a first surface 231 and a second surface 233 of each of the vertical members 230, 232. The first surface 231 and the second surface 233 may be on opposite sides of the vertical members 230, 232 such that the channel cutout 236 may cut into the body of each the members 230,232 towards one another. The depth of each of the channel cutouts in each of the members 230, 232 may be less than half the thickness of the members 230, 232 such that a panel 237 may still remain between the channel cutout 236 made in the first surface 231 and the second surface 233. As shown in FIG. 7B, the channel cutouts 236 made in the first surface 231 and the second surface 233 of the vertical members 230, 232 may configure the free end 235 of the vertical members 230, 232 to substantially resemble the shape of a "H." In the example shown, the channel cutout 236 may substantially resemble a rectangular shape cut into the body of the vertical members 230,232. Alternatively, the shape of the channel cutout 236 may be any other shape including but not limited to that of a rounded "U" or a square.

Turning to FIG. 7A, each of the vertical post members 230,232 may comprise a series of openings 234 positioned within the channel cutout 236 such that each of the openings 234 extend completely through the panel 237. The series of openings 234 in the panel 237 may be positioned adjacent to one another throughout substantially the entire channel cutout 236. The openings 234 in each of the vertical post members 230, 232 may be equally spaced between one another to provide various height adjustments for the body mount 200 when the body post 202 is retained by the body mount retainer 106. The position of each of the openings 234 in the first vertical member 230 may correspond directly with a positionally equivalent opening 234 in the second vertical post member 232 to allow for symmetrical height adjustments on both ends of the body mount 200. The diameter of the opening 234 may substantially match the width of the channel cutout 236 at the first and second surface 231, 233 of each of the vertical members 230, 232 such that a height setting member or a pin may be inserted through both the top opening of the channel cutout 236 and the opening 234 to set the height of the body mount 200. In the embodiment shown, the openings 234 are shown with a circular shape. Alternatively, the openings 234 may be any other shape that may be configured to receive the height setting member.

For adjusting the height or initiating movement of the body mount 200 in the Z direction, the vertical post members 230, 232 directly contacting the body mount retainer 106 may be adjusted accordingly. As shown in FIG. 4A, each of the vertical post members 230, 232 may be retained by the body mount retainer 106 for setting the height of the body mount 200. The height of the body mount 200 may be set by threading a pin or fastener through holes in the retainer 106 and one of the openings 234 in each of the vertical post members 230, 232. Adjusting the height of the body mount 200 using the body post 202 may adjust the height of both body supports 210, 212 on the body mount 200. Due to the symmetrical nature of vehicle bodies, independent separate movements of each of the first and second body supports 210, 212 in the Z direction is not necessary.

As shown in FIG. 6, the horizontal post member 238 may comprise a first cap pocket 240, a second cap pocket 242, and four bores 244A-D each formed in a top surface 248 of the horizontal post member 238. Starting from the most outer ends of the horizontal post member 238, the first cap pocket 240 may be formed in the top surface 248 of the horizontal post member 238 near the end of the member 238 where the first vertical post member 230 connects. The first cap pocket 240 may be formed in the top surface 248 opposite of where the first vertical post member 230 intercepts the bottom surface 246 of the horizontal post member 238. At the opposite end of the horizontal post member 238, the second cap pocket 242 may be formed in the top surface 248 opposite of the where the second vertical post member 232 intercepts the horizontal post member 238. A portion of the first and second cap pockets 240, 242 may extend beyond the edges of the first and second vertical post members 230, 232 such that the perimeter of the first and second cap pockets 240, 242 may extend around the perimeter of the first and second vertical posts 230, 232. Each of the cap pockets 240, 242 may comprise a cavity with an opening extending from the top surface 248 into the body of the horizontal member 238. In the example shown, the first and second cap pockets 240, 242 may be circular in shape and comprise a cylindrical cut out. Alternatively, the first and second cap pockets 240, 242 may be configured to be any other shape formed in conjunction with a respective shaped cutout.

Moving from the first and second cap pockets 240, 242 at the edges of the horizontal post member 238, the member 238 may further comprise a first bore 244A and a second bore 244B between the first and second cap pockets 240, 242. The first bore 244A may be close to and adjacent to the first cap pocket 240, and the second bore 244B may be close to and adjacent to the second cap pocket 242. The horizontal post member 238 may further comprise a third bore 244 C and a fourth bore 244D between the first and second bores 244A, 244B. The third bore 244C may be close to and adjacent to first bore 244A on the opposite side of the first cap pocket 240. The fourth bore 244D may be close to and adjacent to second bore 244B on the opposite side of the second cap pocket 242. Bores 244A-D may be positioned such that the first bore 244A is between the first cap pocket 240 and third bore 244C. The second bore 244B may be positioned between the second cap pocket 242 and the fourth bore 244D. Each of the bores 244A-244D may comprise an opening extending through the entire body of the horizontal post member 238 from the top surface 281 to the bottom surface 246. Each of the bores 244A-244D may be configured to receive fasteners later described herein to secure the body post slide 204 to the body post 202.

Figure 8A:
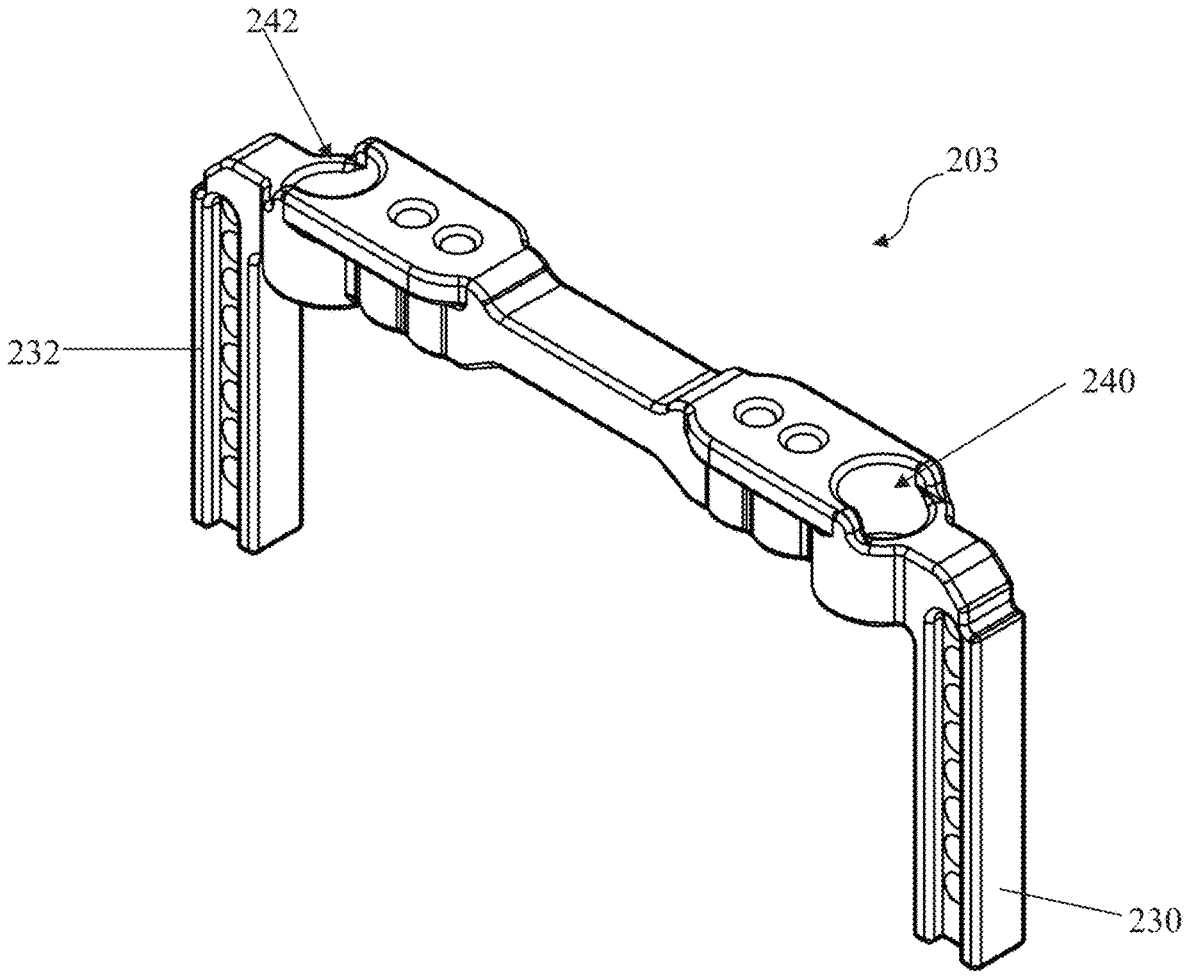
FIG. 8A shows an alternative embodiment of the body post.

As shown in FIG. 7A, the vertical post members 230, 232 contacting the bottom surface 246 of the horizontal post member 238 may extend from underneath the first and second cap pockets 240, 242. Alternatively, turning to FIGS. 8A and 8B, the body mount 200 may comprise another embodiment of the body post 203 for use with the vehicle platform 100. In FIG. 8A, the body post 203 may instead be formed with the vertical post members 230, 232 extending from the ends of the of the first and second cap pockets 240, 242. In the body post 203, the vertical post members 230, 232 may not contact the bottom surface 246 of the horizontal post member 238.

Figure 8B:
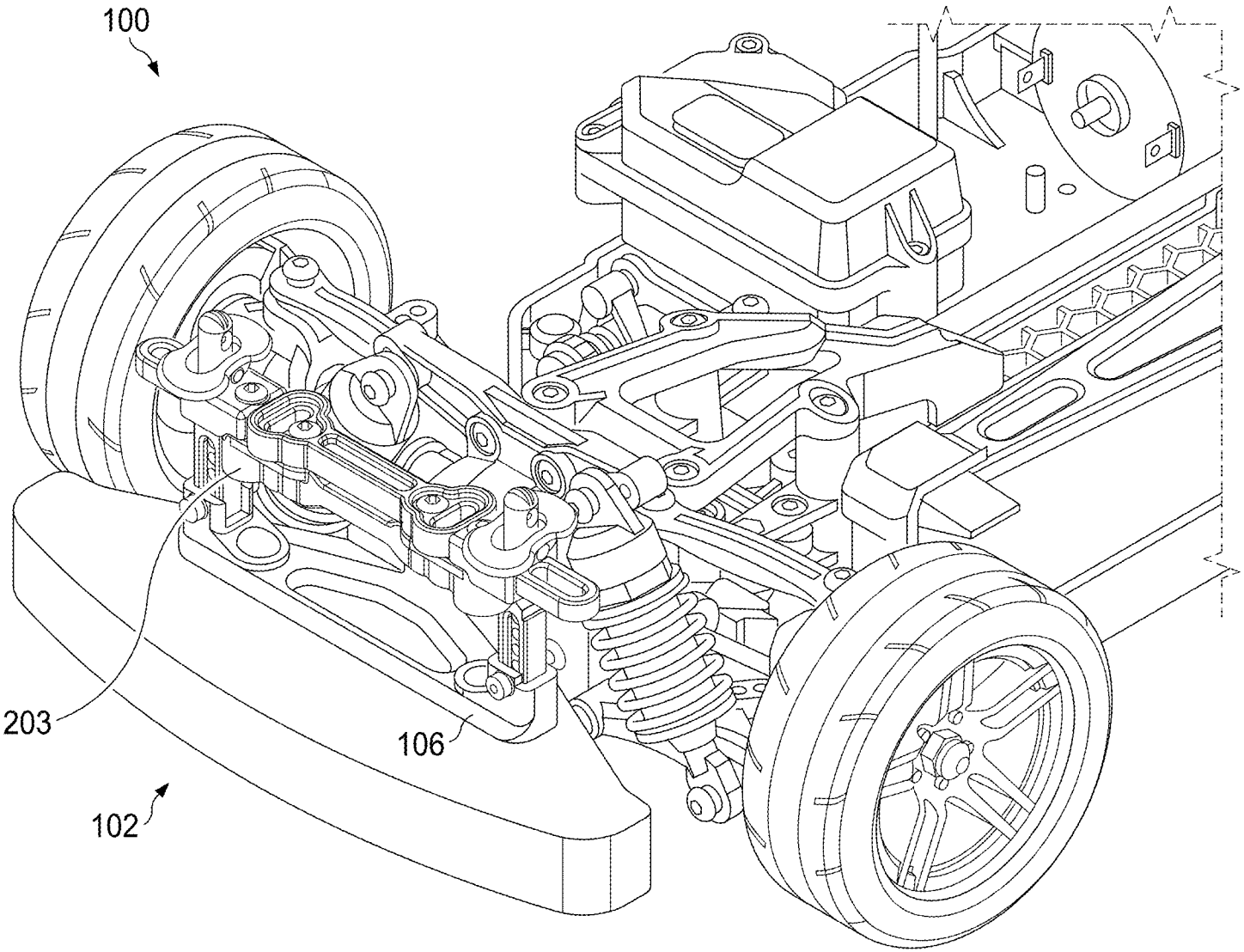
FIG. 8B shows the alternative body post used on the front portion of the vehicle platform.

Aside from the difference in the formation of the vertical post members 230, 232 in relation to the horizontal post member 238, the body post 203 may still comprise the horizontal post member 238 with the first cap pocket 240, the second cap pocket 242, and four bores 244A-D each formed in the top surface 248. The body post 203 may also be similarly used as the body post 202 within the body mount 200 to mount the vehicle body to the vehicle platform 100. As shown in FIG. 8B, the body post 203 may alternatively be used to retain the body mount 200 on the front portion 102 of the vehicle platform 100. The body mount 200 may be configured to use the body post 203 to mount the vehicle body in the same manner as the body post 202 described herein. All features and functions of the body post 202 may similarly be applicable with the body post 203.

Figure 9:
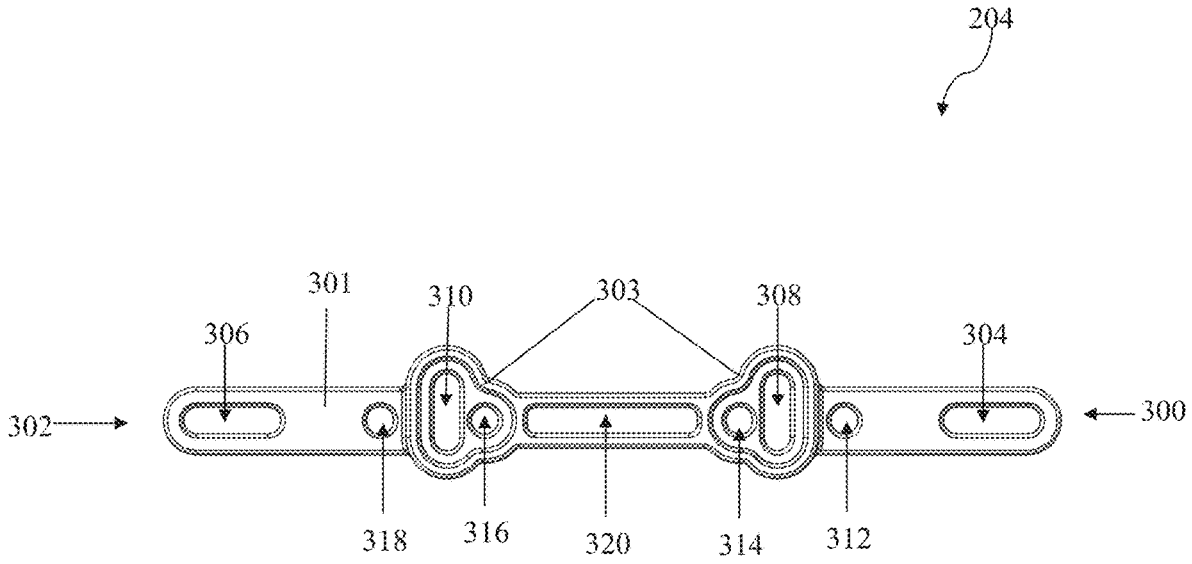
FIG. 9 shows a top view of a body post slide.

Turning to FIGS. 5 and 9, the body post slide 204 may be configured to allow for the movement of the first and second body post caps 206, 208 in the X direction relative to the body post 202. The body post slide 204 may comprise a first end 300 and a second end 302 with a first elongated opening 304 at the first end 300, and a second elongated opening 306 at the second end 302. Each of the first and second elongated openings 304, 306 may extend and stretch along the body of the slide 204 in the Y direction towards the center of the slide 204. Each of the first and second elongated openings 304, 306 may also completely extend through the body of the body post slide 204 from the top to the bottom.

Between the first and second elongated openings 304, 306, the body post slide 204 may further comprise a third elongated opening 308 and a fourth elongated opening 310. The third elongated opening 308 may be closer to the first elongated opening 304 such that the third elongated opening 308 is between the first elongated opening 304 and the fourth elongated opening 310. The fourth elongated opening 310 may therefore be positioned between the third elongated opening 308 and the second elongated opening 306. Each of the third and fourth elongated openings 308, 310 may extend and stretch along the body of the slide 204 in the X direction such that the third and fourth openings 308, 310 may be substantially perpendicular to the first and second elongated openings 304, 306.

The body post slide 204 may further comprise a first bore 312 and a second bore 314 on each side of and adjacent to the third elongated opening 308 such that the first bore 312 may be positioned between the first elongated opening 304 and the third elongated opening 308. The slide 204 may further comprise a third bore 316 and a fourth bore 318 on each side of and adjacent to the fourth elongated opening 310 such that the fourth bore 318 may be positioned between the fourth elongated opening 310 and the second elongated opening 306. The second and third bores 314, 316 may be positioned between the third and fourth elongated openings 308, 310 towards the center of the slide 204.

As shown in FIG. 9, the outer perimeter of the body post slide 204 may substantially follow and outline the shape of the first, second, third, and fourth elongated openings 304, 306, 308, 310 as well as the second and third bores 314, 316. The shape of the first and second ends 300, 302 of the slide 204 may substantially match the shape of the ends of the first and second elongated openings 304, 306 closest to each of the respective ends of the slide 204. In the example shown, the first and second elongated openings 304, 306 may be formed like an elongated oval such that the ends of the openings are rounded like a semi-circular. The first and second ends 300, 302 of the slide 204 substantially match the shape of the ends of the first and second elongated openings 304, 306 and therefore may be semi-circular in shape as well. Alternatively, the shape of the ends of the slide 204 and the ends of the openings 304, 306 may be any other shape including but not limited to being rectangular with corners.

The third elongated opening 308 adjacent the second bore 314, and the fourth elongated opening 310 adjacent the third bore 316, may each further comprise a boss or a raised perimeter 303 extending from the top surface 301 of the slide 204. The boss around each of the respective aforementioned elongated opening and bore placements may extend longitudinally across the body of the slide 204 creating an elevated raised surface between the second and third bores 314, 316. The elevated raised surface may further comprise an elongated concave depression 320 around the center portion of the slider 204 extending between the second and third bores 314, 316. The depth of the elongated depression 320 may substantially match the height of the boss around each of the respective aforementioned elongated opening and bore placements such that the base of the depression 320 may substantially match height of a top surface 301 of the slide 204. In the example shown, the elongated depression 320 may be formed in the shape of a rectangular cutout with rounded corner. Alternatively, the elongated depression 320 may be formed in other shapes including but not limited to elongated ovals.

Figure 14:
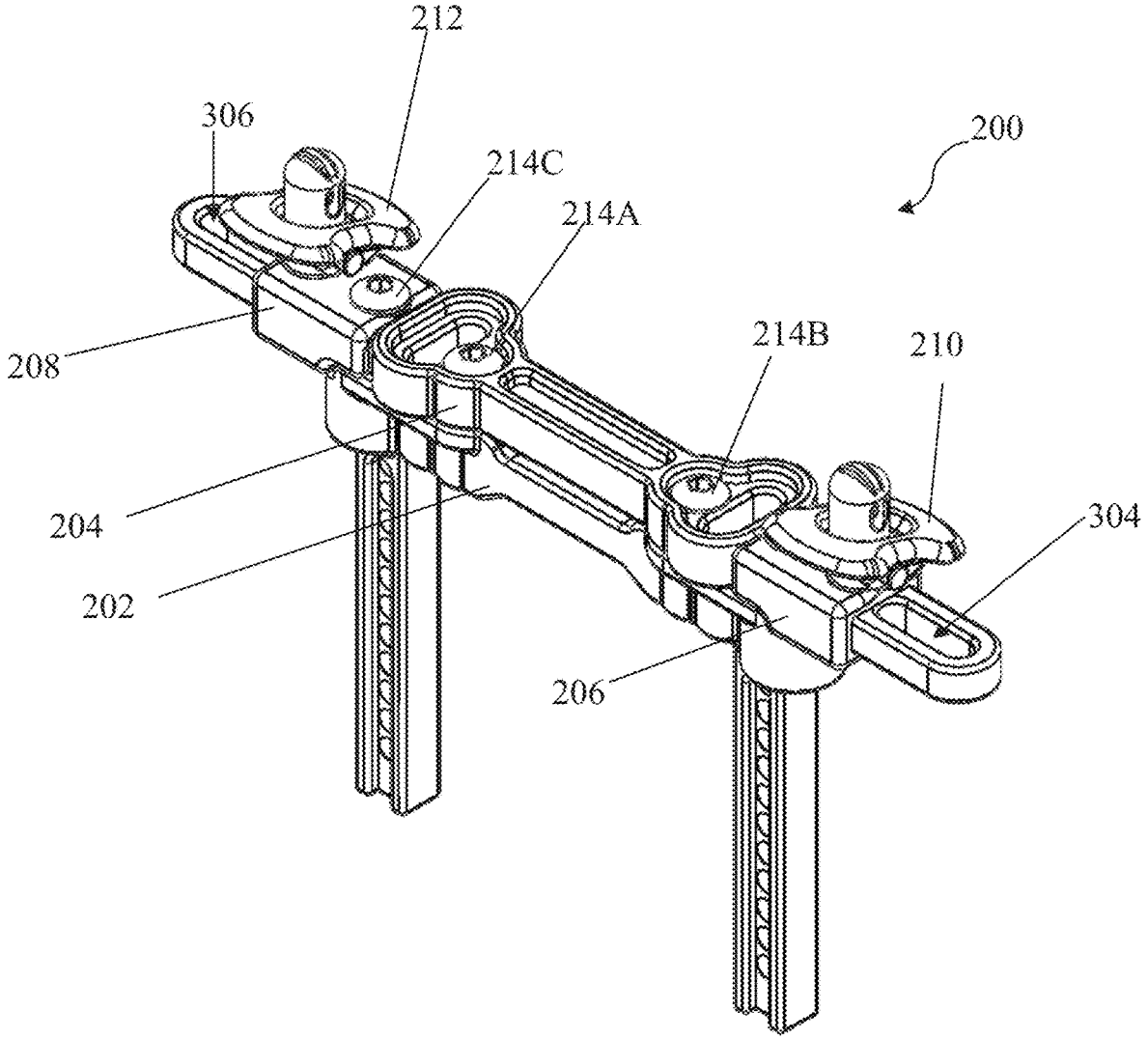
FIGS. 14 and 15 show a perspective and exploded view of the body mount in a fixed configuration.
Figure 15:
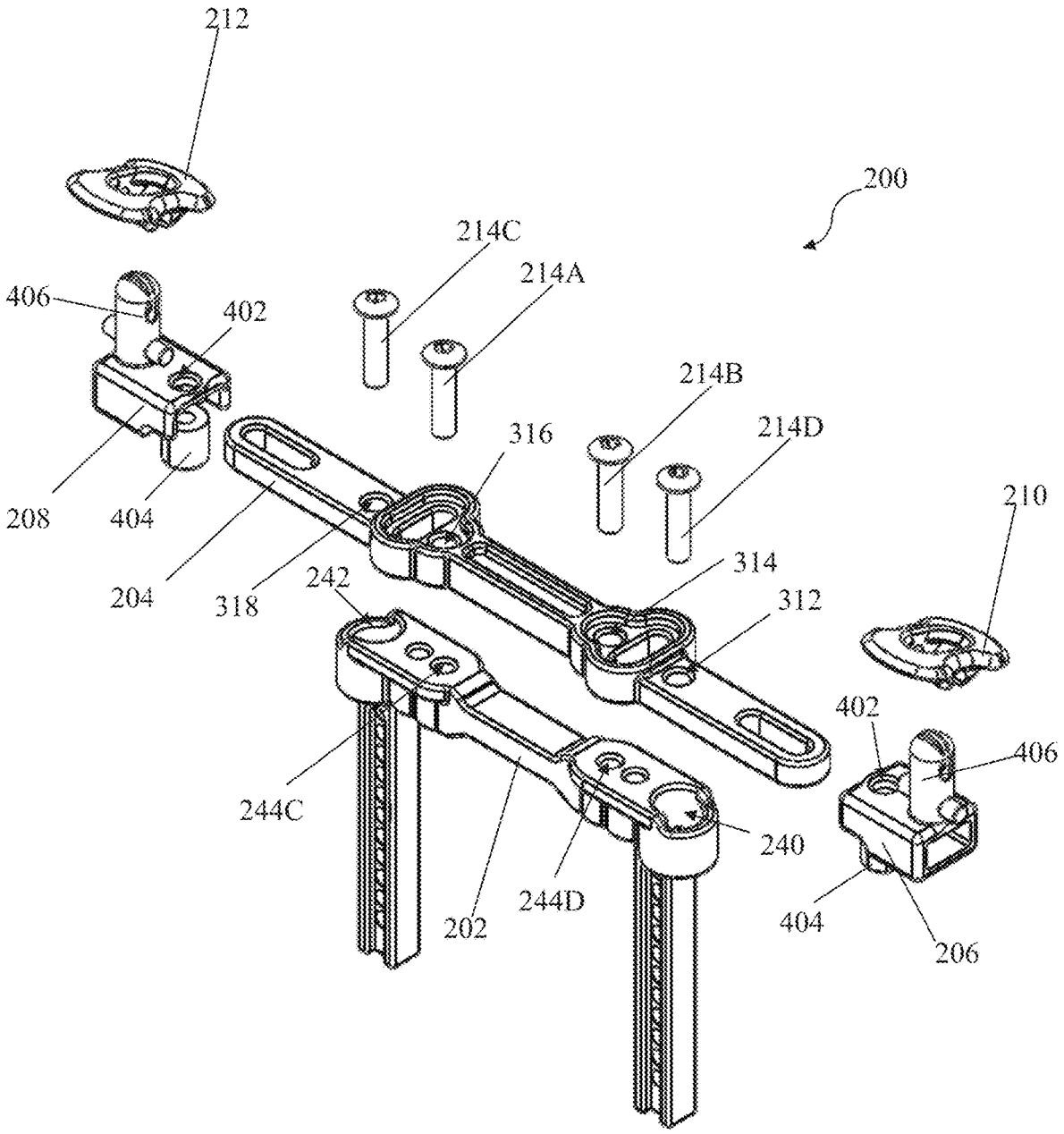
Figure 16:
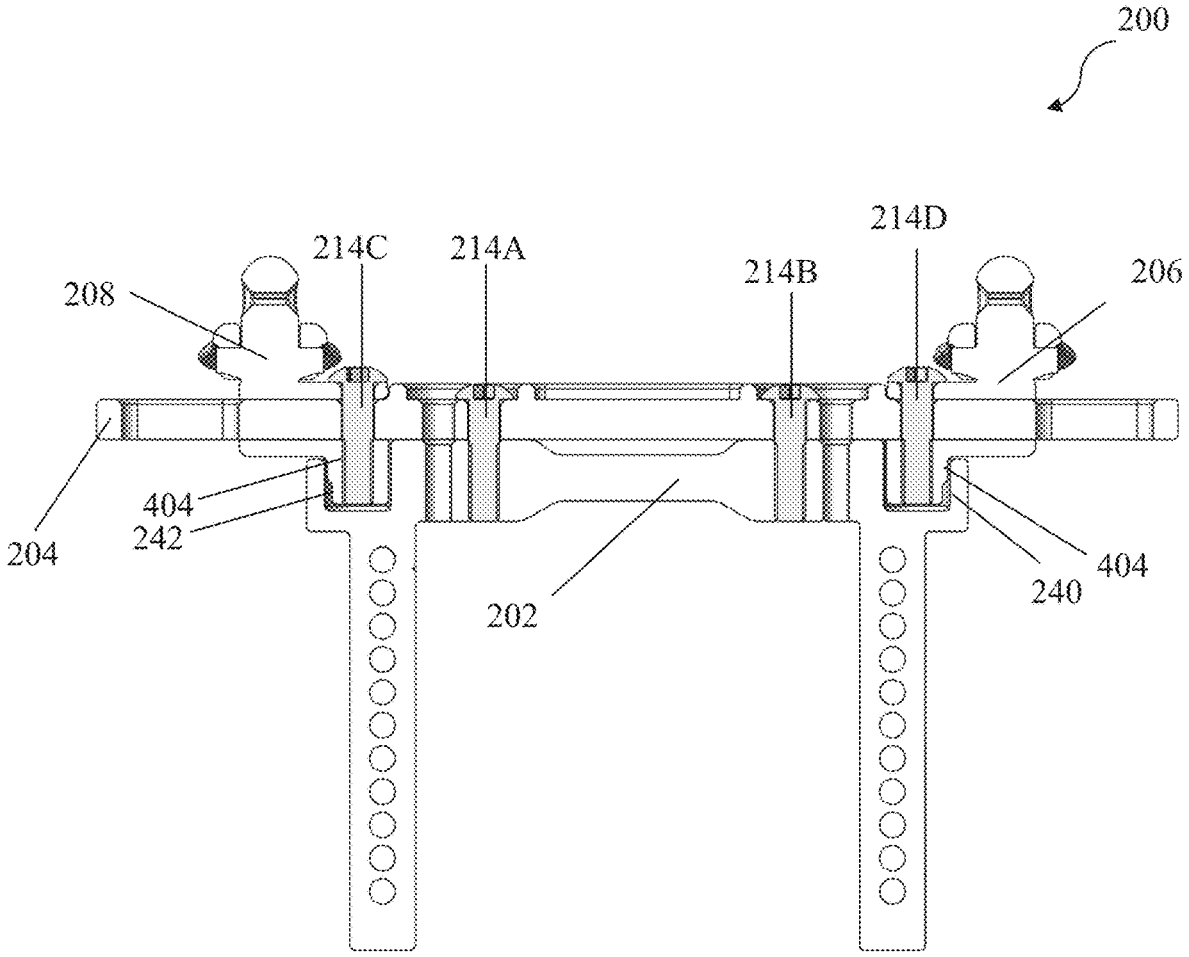
FIG. 16 shows a cross-sectional frontal view of the body mount in a fixed configuration.

Turning to FIGS. 14-16, the body post slide 204 may be removably secured to the body post 202 by a first and second fastener 214A, 214B. Depending on the configuration of the body mount 200 desired by the user, namely fixed or movable, the first and second fasteners 214A, 214B may be threaded through either the second and third bores 314, 316 or the third and fourth elongated openings 308, 310. If the fixed configuration of the body mount 200 is desired, as shown in FIG. 12, the first and second fasteners 214A, 214B may first be threaded through the second and third bores 314, 316 in the slide 204, respectively. Then as shown in FIG. 16, the body slide 204 may be secured to the body post 202 by further threading the first and second fasteners 214A, 214B into the third and fourth bores 244C, 244D in the body post 202, respectively. In this configuration, the body slide 204 is secured to the body post 202 such that the body slide 204 cannot be moved independent of the body post 202. The first and second fasteners 214A, 214B used may be any re-useable mechanical fasteners including but not limited to screws, bolts, and the like.

Figure 17:
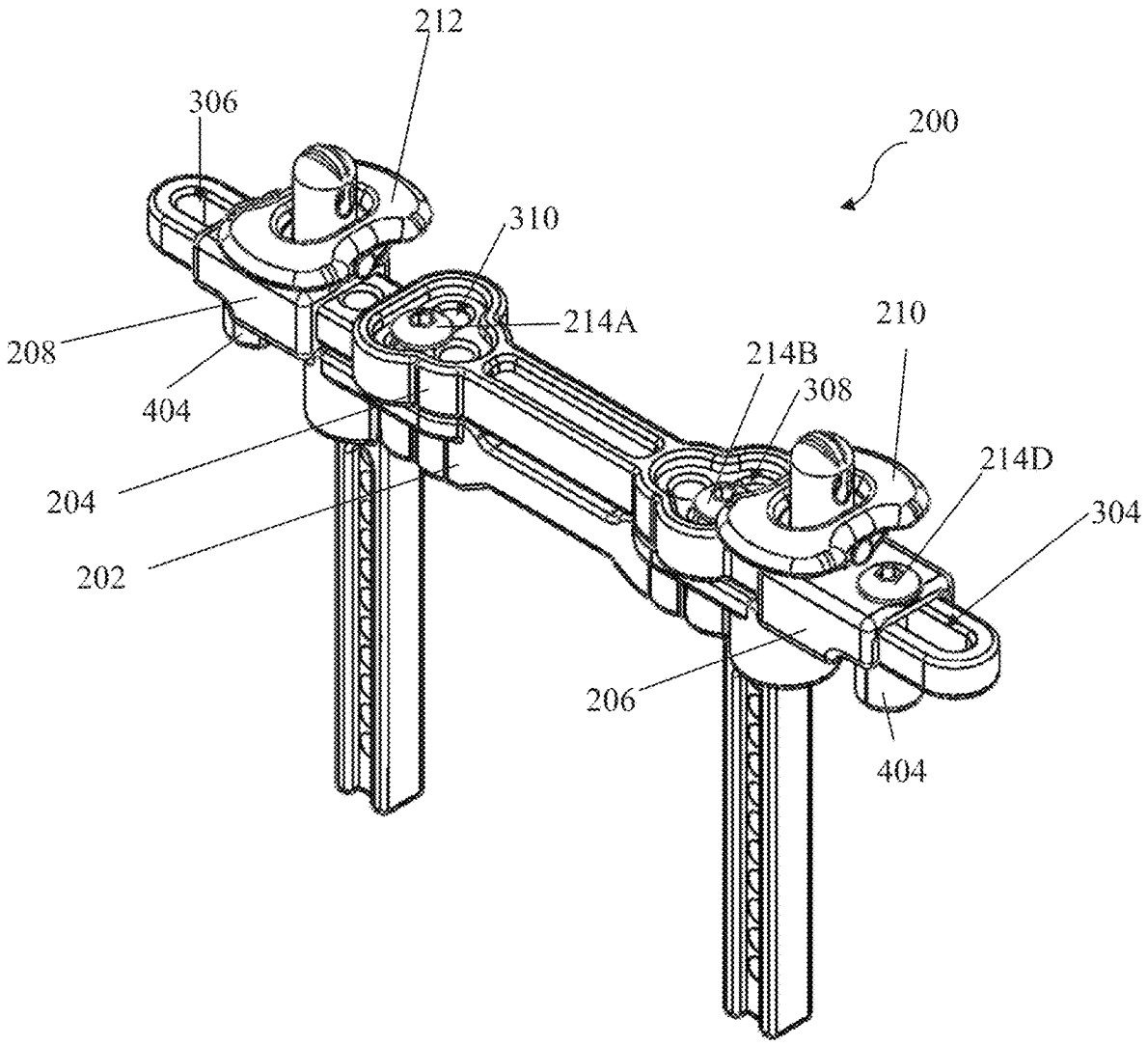
FIGS. 17 and 18 show a perspective and exploded view of the body mount in a movable configuration.
Figure 18:
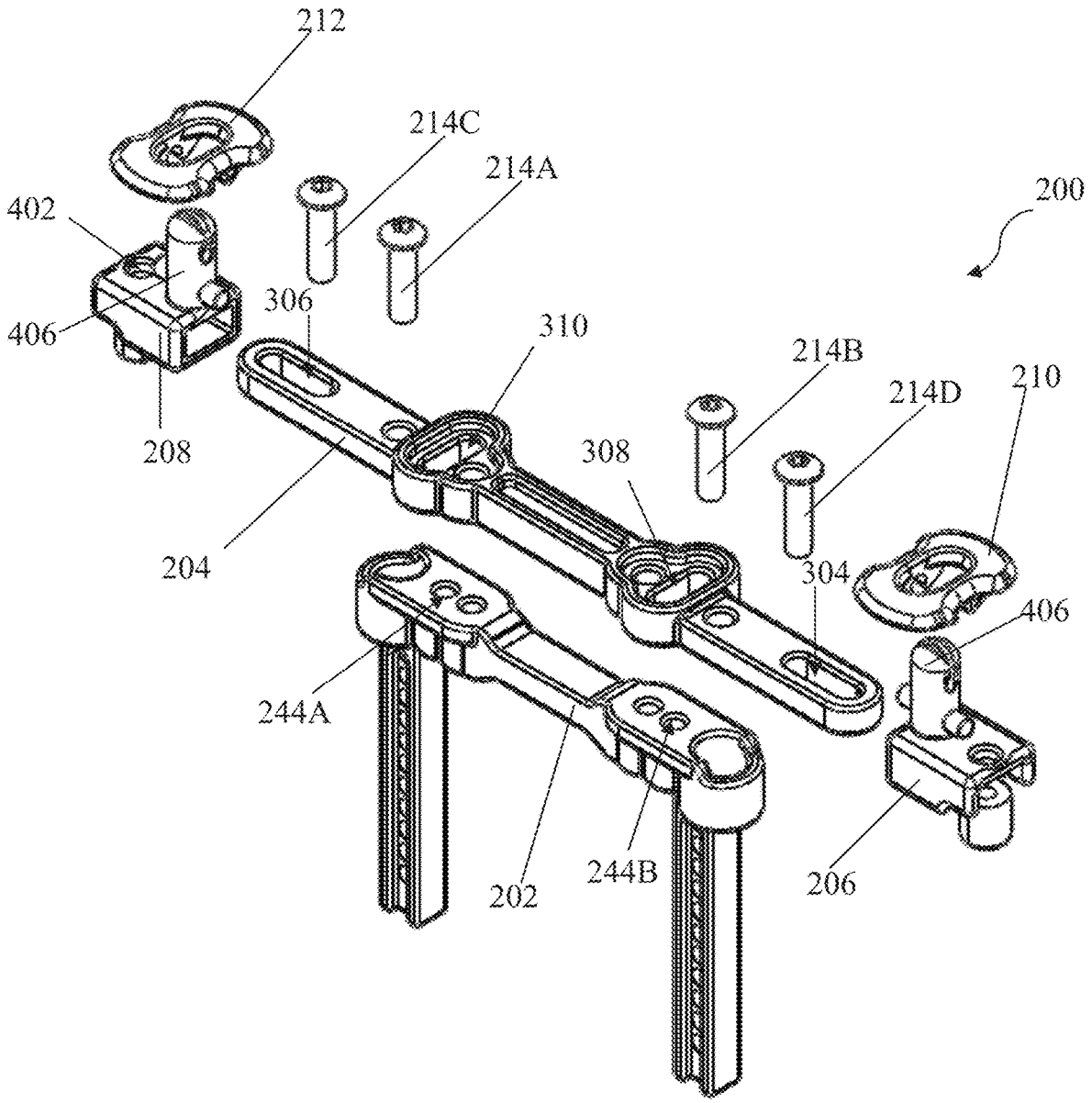
Figure 19:
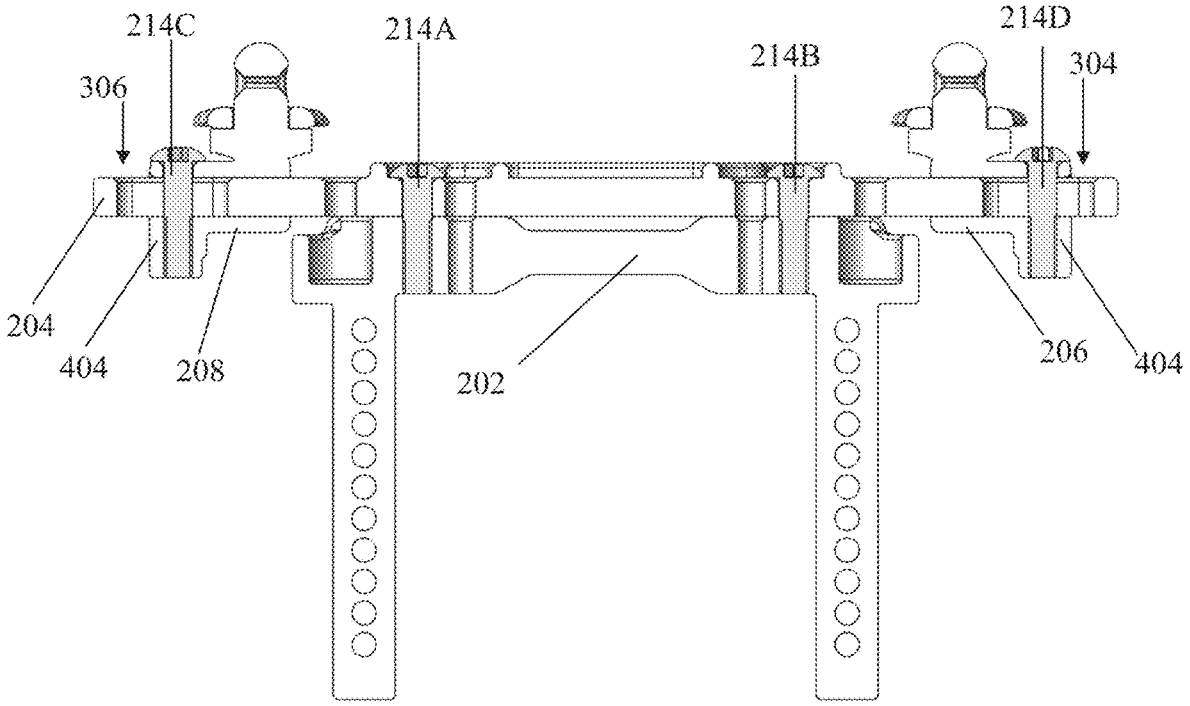
FIG. 19 shows a cross-sectional frontal view of the body mount in a movable configuration.

Turning to FIGS. 17-19, alternatively, the body mount 200 maybe configured to the movable configuration to allow for the body post slide 204, and thereby inherently all other parts connected to the body slide 204 including the first and second body supports 210, 212, to move in the X direction independent of the body post 202. For the movable configuration of the body mount 200, the body slide 204 may be secured to the body post 202 by threading the first and second fasteners 214A, 214B first through the third and fourth elongated openings 308, 310, then the first and second bores 244A, 244B in the body post 202. When secured in this configuration, the body slide 204 may be shifted in the X direction relative to the first and second fasteners 214A, 214B fixed to the body post 202.

The body slide 204 may be moved by sliding the interior contacting surface of the third and fourth elongated openings 308, 310 against the first and second fasteners 214A, 214B. The body slide 204 may be moved to the extent where the first and second fasteners 214A, 214B may contact each of the opposite ends of the elongated openings 308, 310 each of the respective fasteners are threaded through. The extent of the movement of the body slide 204 in the X direction relative to the body post 202 may therefore depend on the size of the third and fourth elongated openings 308, 310. The movement of the body slide 204 using the elongated openings 308, 310 may allow for minute adjustments in the X direction of the position of the body mount 200.

In order to allow for the elongated openings 308, 310 to better slide and move around the fasteners 214A, 214B, there may be limited contact between the interior surface of the elongated openings 308, 310 and the fasteners 214A, 214B to allow for controlled and intentional movement of the slide 204 by the user. There may still be enough contact or friction such that the position of the fasteners 214A, 214B within the respective elongated openings 308, 310 may be retained and not easily moved when a selected position is set. In an embodiment, the interior surface of the elongated openings 308, 310 may be smooth and not threaded. The fasteners 214A, 214B may also be configured such that only the tip of the fasteners contacting the bores in the body 202 may be threaded.

Figure 10A:
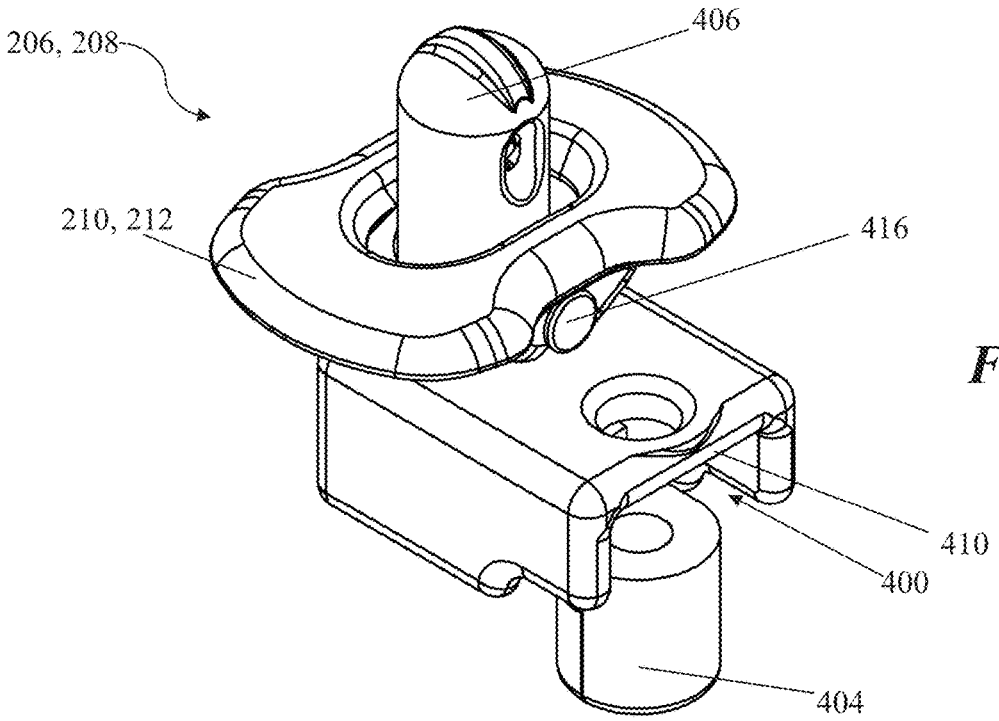
FIGS. 10A and 10B show a perspective and frontal views of a body support coupled with a body post cap.
Figure 10B:
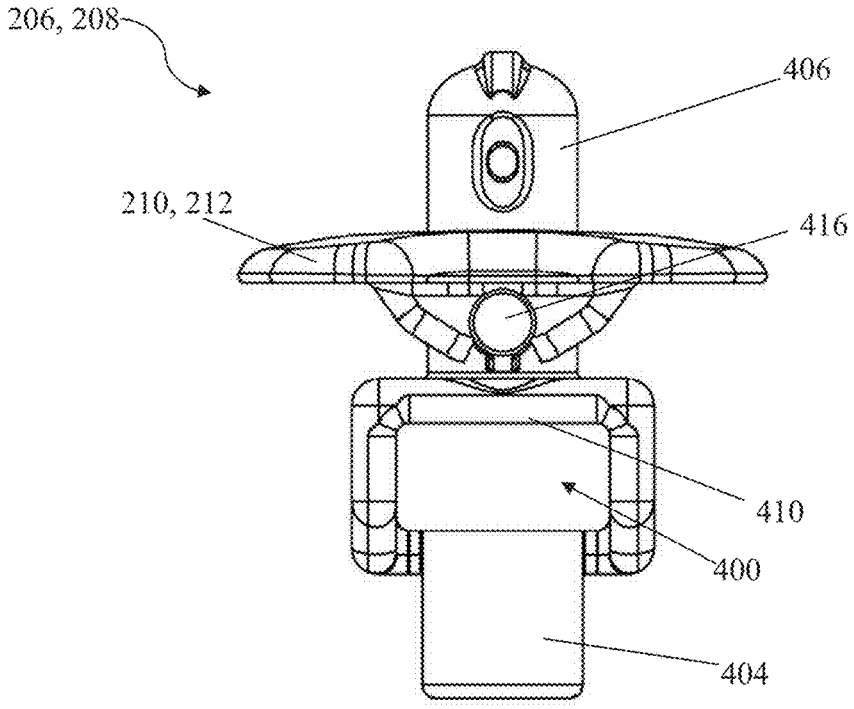

Turning to FIGS. 5, 10A, and 10B, the first body post cap 206 and the second body post cap 208 may be slidably connected to the body post slide 204. The first body post cap 206 and the second body post cap 208 may be substantially the same in construction. The first body post cap 206 may slidably connect the first body support 210 to the body mount 200. The second body post cap 208 may slidably connect the second body support 212 to the body mount 200. The first and second body post caps 206, 208 may allow for the first and second body supports 210, 212, respectively, to be adjusted and move in the Y direction independent of the body post 202 along the body slide 204.

As shown in FIGS. 11A-11D, each of the body post caps 206, 208 may comprise a slide opening 400, a cap bore 402, a cap retainer 404, a cap mount 406, a first end 408, and a second end 410. The slide opening 400 may comprise a passage opening extending from the first end 408 of the body post caps 206, 208 through to the second end 410. The cap mount 406 may be formed extruding out of a top surface 401 of the body post caps 206, 208. The cap mount 406 may be positioned adjacent the edge of the top surface 401 near the first end 408 of the body post caps 206, 208. The cap bore 402 may be formed adjacent the cap mount 406 in the top surface 401 of the body post caps 206, 208. The cap bore 402 may extend into the slide opening 400. The cap bore 402 may be positioned adjacent the edge of the top surface 401 near the second end 410 of the body post caps 206, 208.

The cap retainer 404 may be formed extending from a bottom surface 403 of the body post caps 206, 208. The cap retainer 404 may comprise a retainer bore 412 extending from the slide opening 400 into the cap retainer 404. The cap retainer 404 may be positioned below the cap bore 402 such that the cap bore 402 may be lined up with the opening of the retainer bore 412. The cap bore 402 and the retainer bore 412 may be lined up such that a fastener from the top surface 401 may be threaded through the cap bore 402, the slide opening 400, and into the retainer bore 412. In an embodiment, the interior surfaces of the cap bore 402 and the retainer bore 412 may be threaded to contact and secure an inserted fastener.

The cap mount 406 may comprise a first pivot member 414, a second pivot member 416, and a cap opening 418. The first and second pivot members 414, 416 may extend from the outer surface of the cap mount 406. The first pivot member 414 and the second pivot member 416 may be positioned on opposite sides of the cap mount 406 such that the first pivot member 414 may extend towards the first end 408 of the body post caps 206, 208 and the second pivot member 416 may extend towards the second end 410. The cap opening 418 may comprise a tunnel extending through the body of the cap mount 406 parallel to the extrusions of the first and second pivot members 414, 416. Each end of the cap opening 418 may be adjacent to one of the pivot members 414, 416 on opposite sides of the cap mount 406. The cap opening 418 may be positioned above the extrusions of the pivot members 414, 416 such that the cap opening 418 is farther away from the top surface 401 of the body post caps 206, 208. The cap opening 418 may be used in securing the vehicle body to the body mount 200.

Figure 11A:
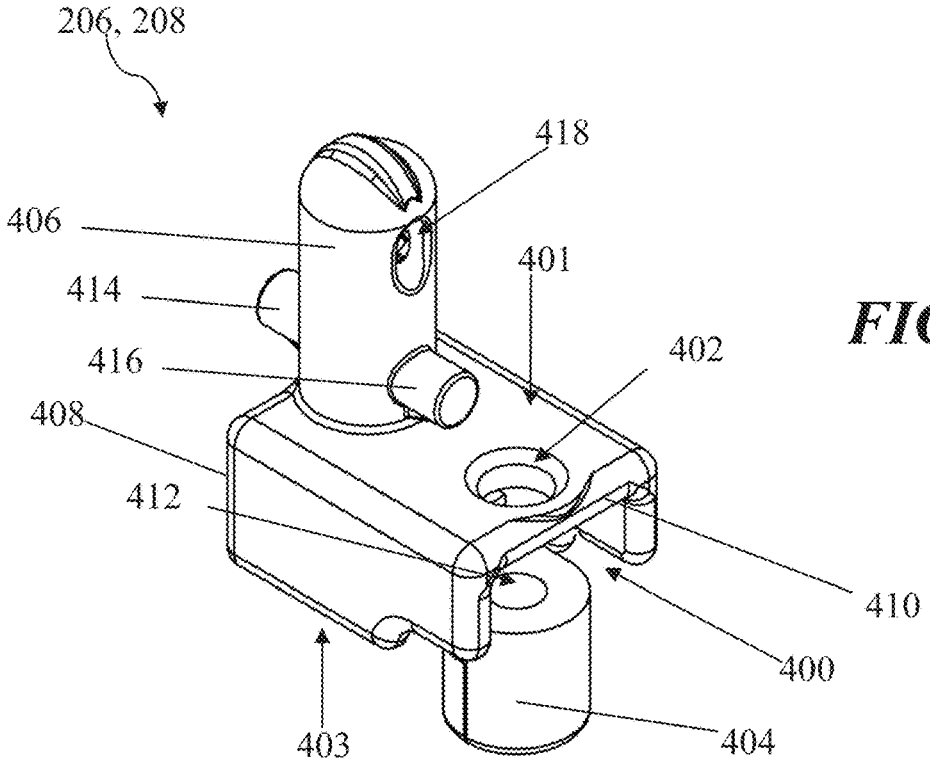
FIGS. 11A-11D show perspective, side, and end views of the body post cap.
Figure 11B:
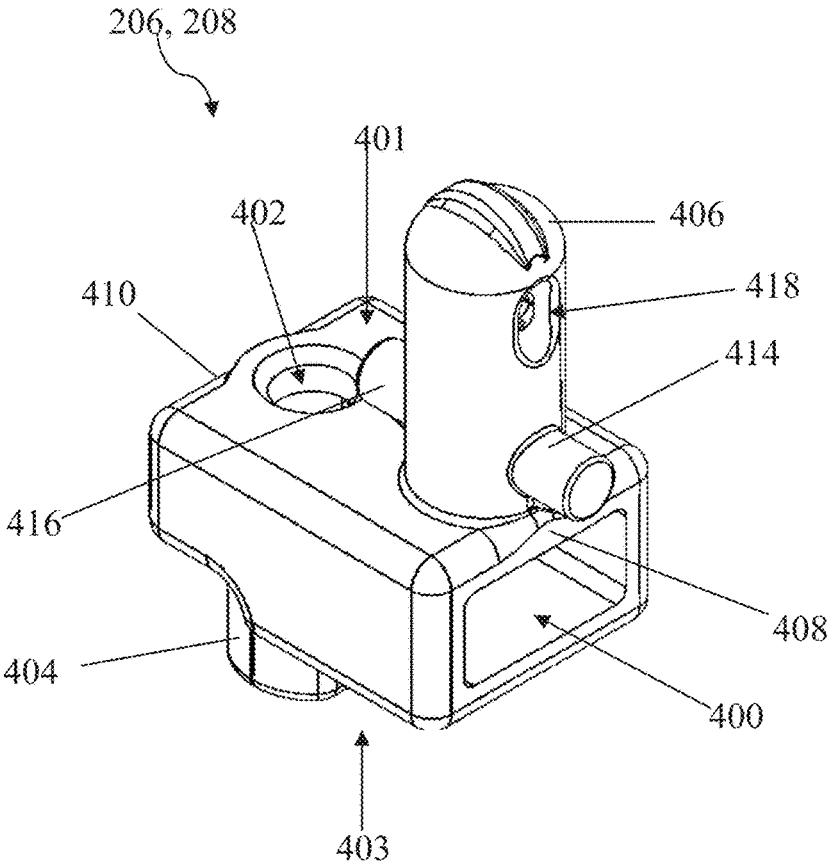
Figure 11C:
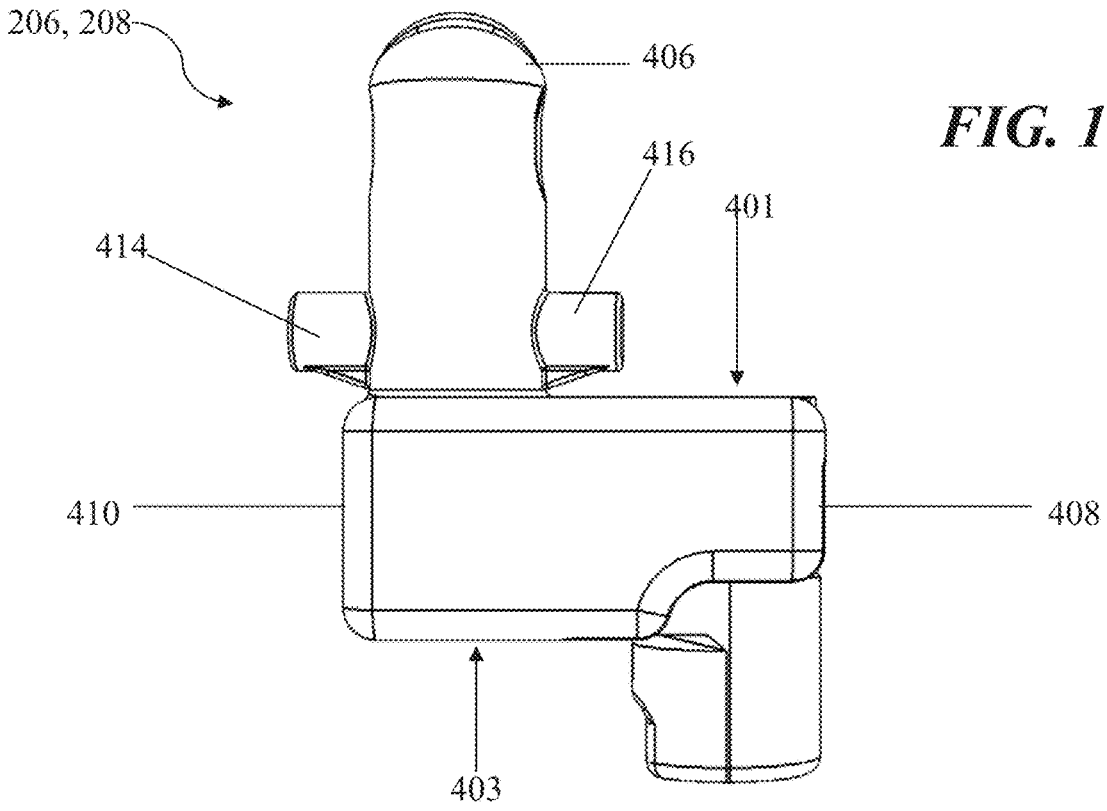
Figure 11D:
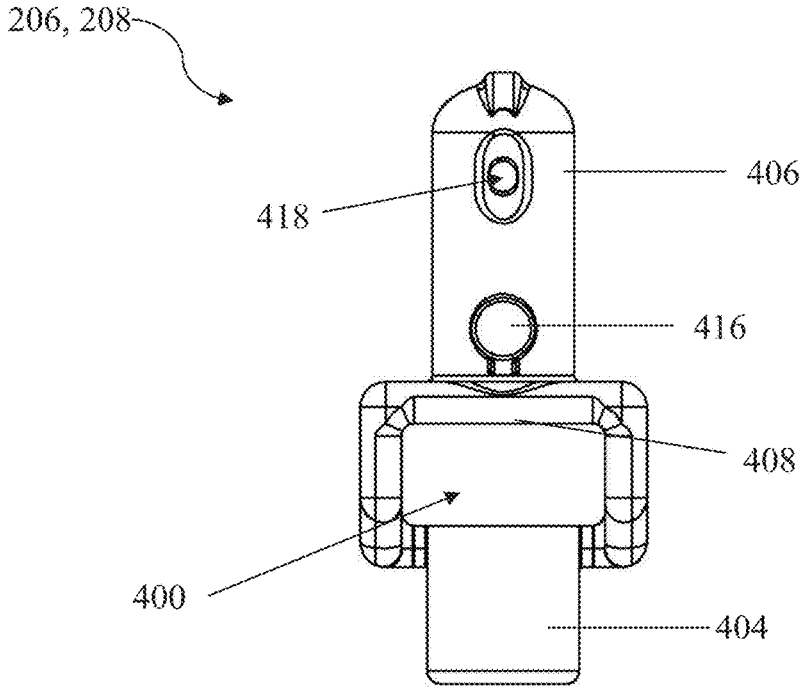
Figure 12A:
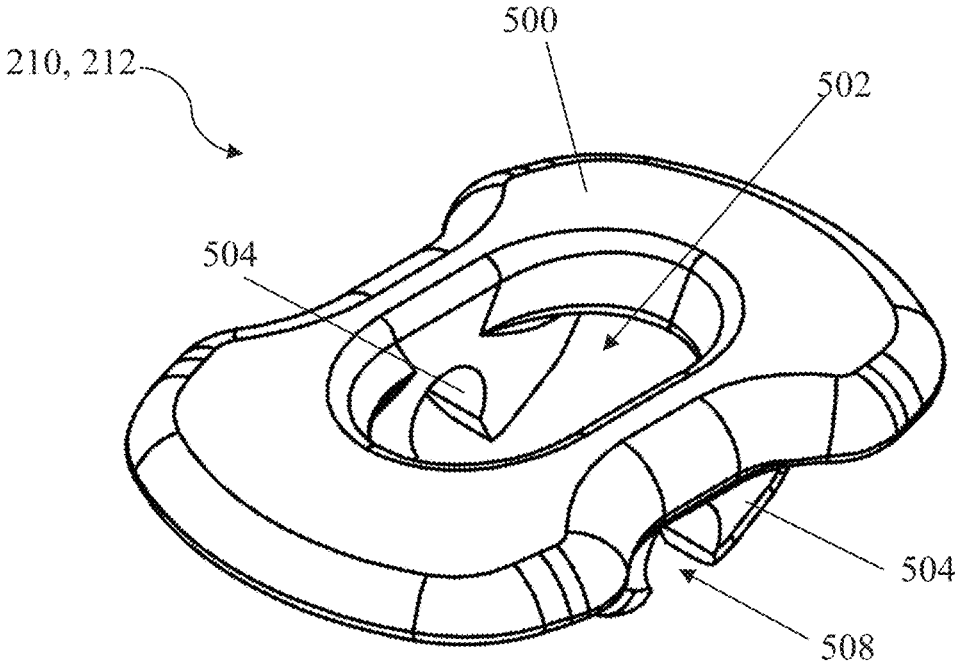
FIGS. 12A-12D show perspective, top, and side views of the body support.
Figure 12B:
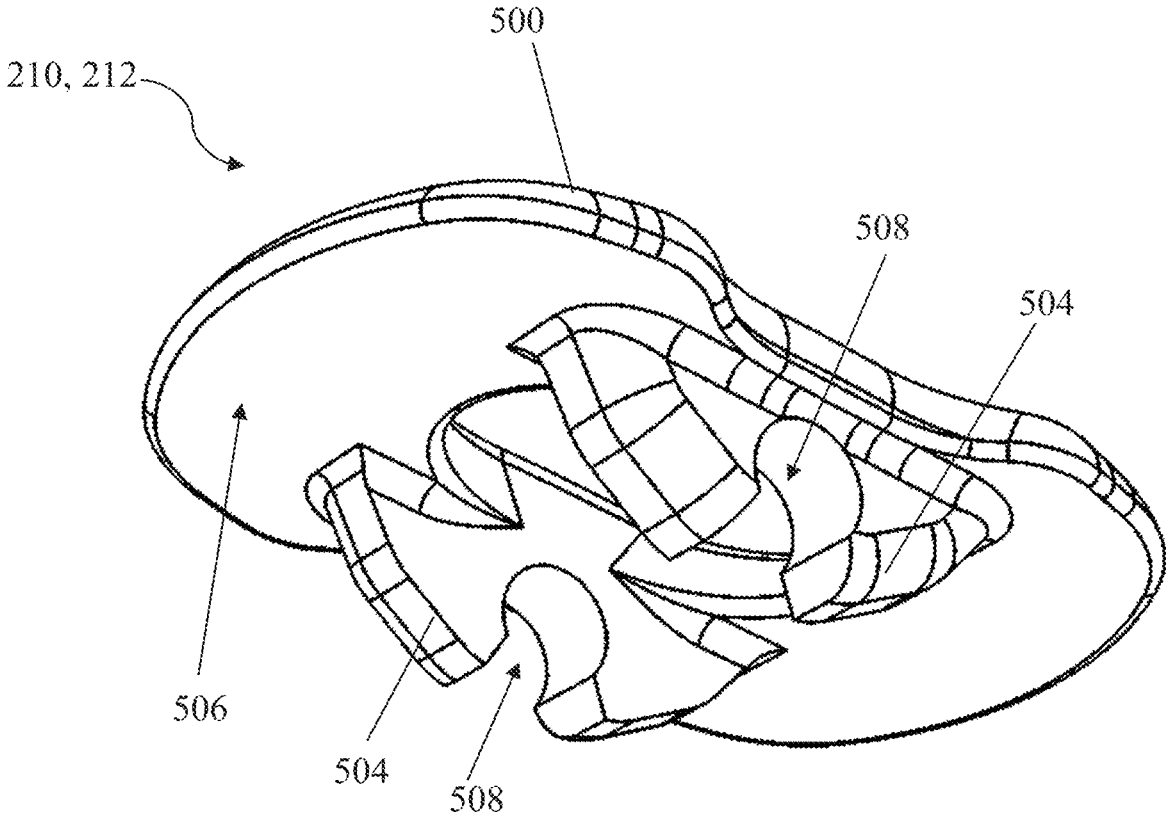
Figure 12C:
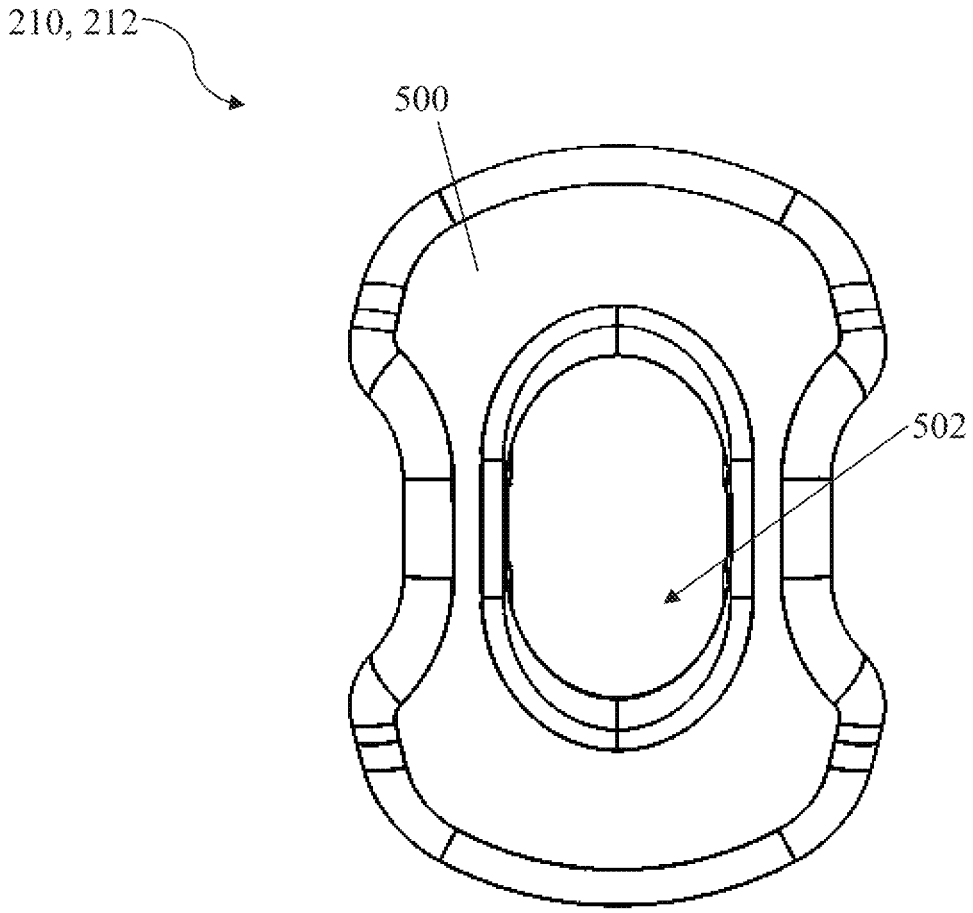
Figure 12D:
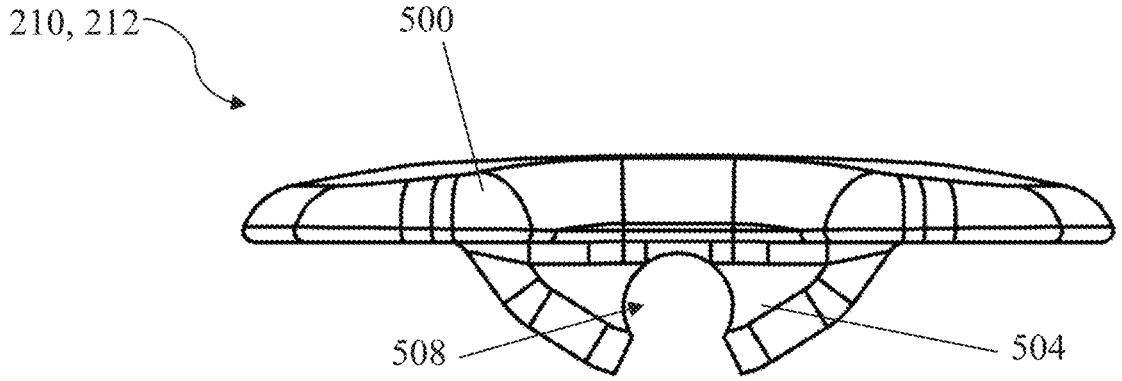

As shown in FIGS. 11A and 11B, the slide opening 400 of the body post caps 206, 208 may be formed such that the body post caps 206, 208 may receive the ends 300, 302 of the body post slide 204. When assembling the body mount 200, the body post caps 206, 208 may be slidably connected to the body post slide 204 by inserting either one of the ends 300, 302 of the body post slide 204 into the slide opening 400. The body post slide 204 may be inserted into either one of the ends 408, 410 of the body post caps 206, 208. The shape and size of the slide opening 400 may be substantially similar to the shape and slightly larger than the ends 300, 302 of the body slide 204. In the embodiment shown, the slide opening 400 is substantially a rectangular prism cutout. Alternatively, the shape of the slide opening 400 may be any other shape depending on the shape of the body slide 204.

The body post caps 206, 208 may be slidably connected to the body slide 204 by inserting the first end 300 of the body slide 204 into the slide opening 400 of the first post cap 206, and inserting the second end 302 of the body slide 204 into the slide opening 400 of the second post cap 208. The ends 300, 302 of the body slide 204 may be inserted into either the first end 408 or the second end 410 of the body post caps 206, 208 depending on the configuration of the body mount 200 being used. For the fixed configuration of the body mount 200, the user may insert the ends 300, 302 of the body slide 204 into slide opening 400 through the second end 410 of the body post caps 206, 208 first. In this position, the cap mount 406 may be farther away from the center of the body slide 204 than the cap retainer 404. If the movable configuration is desired, the user may alternatively insert the ends 300, 302 of the body slide 204 through the first end 408 of the body post caps 206, 208 first. In this position, the cap mount 406 may be closer than the cap retainer 404 towards the center of the body slide 204.

As shown in FIGS. 14-16, when assembling the body mount 200 in the fixed configuration, the first and second body post caps 206, 208 may first be secured on the body post slide 204 using a third fastener 214C and a fourth fastener 214D. As previously mentioned, for the fixed configuration, the body post caps 206, 208 may be connected to the body post slide 204 by inserting the first and second ends 300, 302 of the body slide 204 into the slide opening 400 of the first and second body post caps 206, 208 through the second end 410 first. To secure the first and second body post caps 206, 208 on the body slide 204, upon inserting the ends 300, 302 of the body slide 204 into each respective slide openings 400, the body post caps 206, 208 may be positioned towards the center of the body slide 204 such that the body post caps 206, 208 may contact the raised boss on the body slide 204 around the third and fourth elongated openings 308, 310. In this position, the cap bores 402 of the first and second body post caps 206, 208 may then be aligned with the first and fourth bores 312, 318, of the body slide 204, respectively.

As shown in FIG. 16, the first and second body post caps 206, 208 may then be secured by threading the third and fourth fasteners 214C, 214D through the cap bores 402 in the first and second body post caps 206, 208, respectively, then the first and fourth bores 312, 318 in the body slide 204, respectively, and finally the retainer bores 412 of the first and second body post caps 206, 208, respectively. At this point, the body post caps 206, 208 may be secured to the body slide 204 such that the body post caps 206, 208 may not move in the Y direct relative to the body slide 204.

With the first and second body post caps 206, 208 secured to the body post slide 204, the body post slide 204 may then subsequently be secured to body post 202. As previously described, in order to prevent movement of the body slide 204 in the X direction relative to the body post 202, the first and second fasteners 214A, 214B may be threaded through the second and third bores 314, 316 in the body slide 204 and into the third and fourth bores 244C, 244D in the body post 202. However, in order to prevent movement of the body post caps 206, 208 in the Y direction relative to the body post 202, the cap retainers 404 extending from the first and second body post caps 206, 208 may then be fitted into the first and second cap pockets 240, 244 of the body post 202. The cap retainers 404 may first be aligned and fitted into the cap pockets 240 before the first and second fasteners 214A, 214B are used to secure the body slide 204 to the body post 202. In the fixed configuration, the third and fourth elongated openings 308, 310 may be aligned with first and second bores 244A, 244B in the body post 202 without any fasteners threaded.

Turning to FIGS. 17-19, to assemble the body mount 200 in the movable configuration, the body post caps 206, 208 may alternatively be slidably connected to the body post slide 204 by inserting the ends 300, 302 of the body slide 204 through the first end 408 of the body post caps 206, 208 first. In this position, the cap mounts 406 may be positioned closer towards the center of the body slide 204 than the cap retainers 404. Upon connecting the body post caps 206, 208 to the body slide 204, the cap bore 402 and the retainer bore 412 in each of the body post caps 206, 208 may align with a portion of the first and second elongated openings 302, 304 in the body slide 204. As shown in FIG. 16, the body post caps 206, 208 may then be secured to the body slide 204 by threading the third and fourth fasteners 214C, 214D first through the cap bore 403 in the first and second body post caps 206, 208, respectively, then the first and second elongated openings 302, 304 in the body slide 204, respectively, and finally the cap retainers 404 of the first and second body post caps 206, 208, respectively. In this configuration, the cap pockets 240, 242 in the body post 202, and the first, second, third, and fourth bores 312, 314, 316, 318 in the body slide 204 may not be used and therefore left unthreaded.

When the body post caps 206, 208 are secured to the body slide 204 in this moveable configuration, the body post caps 206, 208 may be moved and shifted in the Y direction relative to the body slide 204. The body post caps 206, 208 may be moved by sliding the third and fourth fasteners 214C, 214D from one end of the elongated openings 304, 306 to the other. The extent of the movement in the Y direction by the body post caps 206, 208 may depend on the size of the first and second elongated openings 304, 306. The body post caps 206, 208 may be moved to the extent where the third and fourth fasteners 214C, 214D may contact each of the opposite ends of the elongated openings 304, 306 each of the respective fasteners 214C, 214D are threaded through.

The body post slide 204 and the body post caps 206, 208 may then be slidably secured to the body post 202 by threading the first and second fasteners 214A, 214B through the third and fourth elongated openings 308, 310 in the body slide 204 and the first and second bores 244A, 244B in the body post 202, respectively. As previously mentioned, in this configuration, the body slide 204 may be moved in the X direction relative to the body post 202, thereby allowing the body post caps 206, 208 secured to the body slide 204 to also be moved in the X direction relative to the body post 202. With the body slide 204 secured to the body post 202 and limited to movement in the X direction relative to the body post 202, the body post caps 206, 208 capable of movement in the Y direction relative to the body slide 204 may also be moved in the Y direction relative to the body post 202.

The ends of the horizontal post member 238 at the opening of the cap pockets 240, 242 on the body post 202 may optionally comprise an indented cut so as to receive the bottom portion of the body post caps 206, 208 when the body post caps 206, 208 are moved in the Y-direction towards the center of the body slide 204 and the body post 202. The need and size of the indented cutout may depend on the extent of the movement of the body post caps 206, 208 allowed by the size of the first and second elongated openings 304, 306.

Turning to FIGS. 5, 10A, and 10B, the body mount 200 may further comprise the first and second body supports 210, 212, rotationally attached to the first and second body post caps 206, 208, respectively. As shown in FIGS. 12A-12D, the body supports 210, 212 may comprise a mount surface 500 with a mount opening 502 through the center portion of the mount surface 500. The body supports 210, 212 may further comprise two snap receivers 504 extending from a bottom surface 506 of the mount surface 500. Each of the snap receivers 504 may be positioned directly across from one another on opposite sides of the mount opening 502.

The snap receivers 504 may comprise a cavity 508 that the pivot members 414, 416 may rotate within. The cavity 508 may therefore be shaped substantially similar to the outer shape of the pivot members 414, 416 to allow for the rotation of the pivot members 414, 416. The cavity 508 of the snap receivers 504 may further comprise an opening for inserting the pivot members 414, 416 to couple the pivot members 414, 416, and the snap receivers 504 together. The opening may be sized slightly smaller than the diameter of the pivot members 210, 212 such that the pivot members 210, 212 may be coupled with slight force by the user. This may also prevent the body supports 210, 212 from inadvertently detaching from the body post caps 206,208 when assembled.

As shown in FIGS. 10A and 10B, the body supports 210, 212 may be attached to the body post caps 206, 208 by threading the top end of the cap mount 406 through the mount opening 502 and coupling the first and second pivot members 414, 416 within the two snap receivers 504. The coupling of the snap receivers 504 with the first and second pivot members 210, 212 may form a pair of hinges such that the mount surface 500 may rotate or pivot back and forward like a lever around the first and second pivot members 414, 416.

Figure 13A:
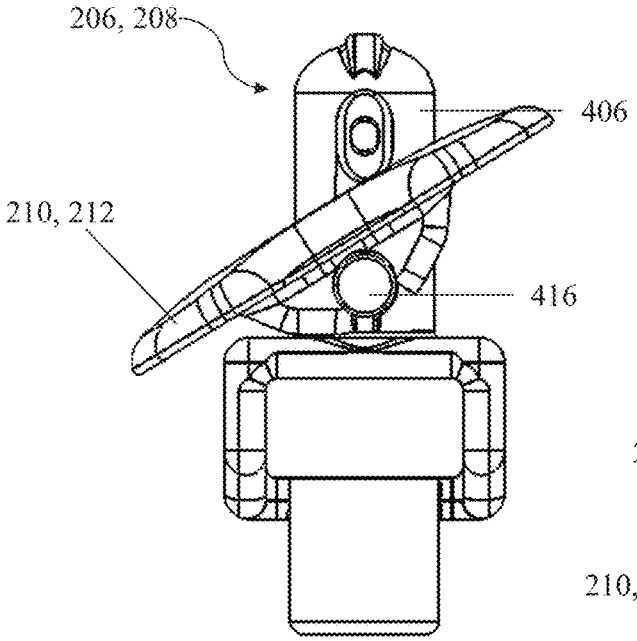
FIGS. 13A-13C show the body support pivoting around the body post cap.
Figure 13B:
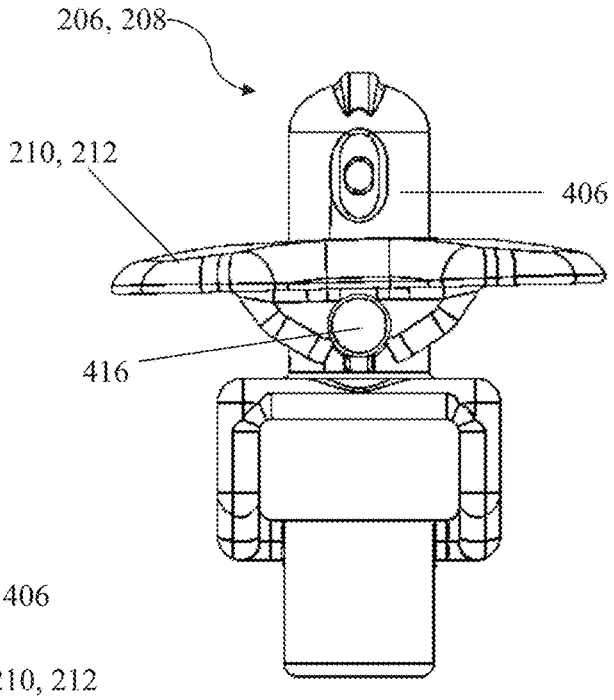
Figure 13C:
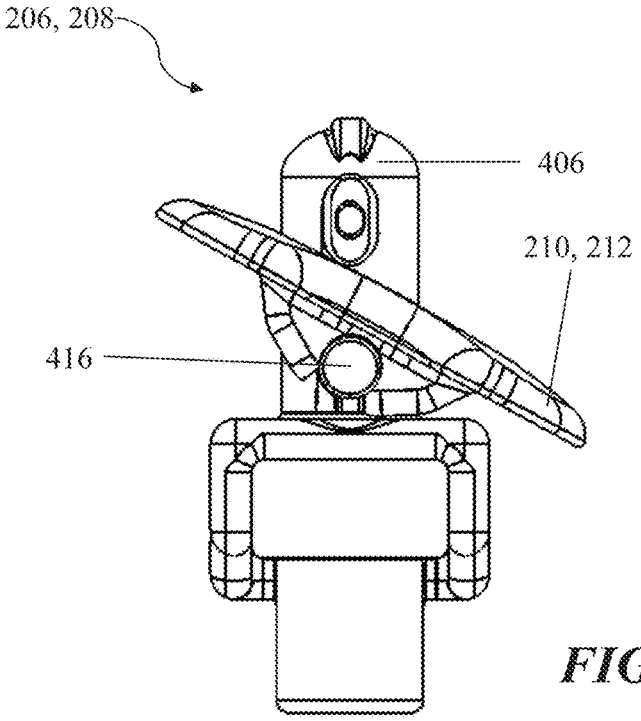

Turning to FIGS. 13A-13C, positions reflecting the pivoting of the body supports 210, 212 when coupled to the body post caps 206, 208 are shown. When coupled, the snap receivers 504 may rotate around each of the pivot members 414, 416. Since the cap mount 406 is threaded through the mount opening 502 when the body supports 210, 212 are attached to the cap posts 206, 208, the mount opening 502 may move relative to the cap mount 406 during the pivoting of the body supports 210,212. The body support 210, 212 may pivot in each direction until the interior edge of the mount opening 502 contacts the outer surface of the cap mount 406. FIGS. 13A and 13C show the various pivoting positions of the body support 210, 212, and the extent of the pivoting in each direction relative to the body post caps 206,208. In FIG. 13A, the body support 210, 212 may pivot to the left until the interior right edge of the mount opening 502 contacts the upper right portion of the cap mount 406. In FIG. 13B, the body suppot 210, 212 may pivot the right until the interior left edge of the mount opening contacts the upper left portion of the cap mount 406. Use of the body mount 200 may therefore allow for adjustments in the X, Y, and Z direction to mount the vehicle body on the vehicle platform 100 in the exact location the user desires. The body mount 200 may also be configured from a movable configuration into a fixed configuration for manufacturing ease and consistency.

Having thus described the present invention by reference to certain of its exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of exemplary embodiments. Accordingly, it is appropriate that any claims supported by this description be construed broadly and in a manner consistent with the scope of the invention.

The invention claimed is:

1. A body mount system for a model vehicle comprising:

a body post attached to a model vehicle platform at a desired vertical height;

a body slide attached to the body post with body slide fasteners attached via a fixed body slide fastener location providing no adjustment for positioning the body slide relative to the body post prior to tightening the body slide fastener or with the body slide fasteners attached via an adjustable body slide fastener location providing adjustment for positioning the body slide relative to the body post, prior to tightening the body slide fastener;

a first body post cap attached to a first end of the body slide with a first body post cap fastener attached via a fixed first body post cap fastener location providing no adjustment for positioning the first body post cap relative to the first end of the body slide prior to tightening the first body post cap fastener or with the first body post fastener attached via an adjustable first body post cap fastener location providing adjustment for positioning the first body post cap relative to the first end of the body slide, prior to tightening the first body post cap fastener;

a second body post cap attached to a second end of the body slide with a second body post cap fastener attached via a fixed second body post cap fastener location providing no adjustment for positioning the second body post cap relative to the second end of the body slide prior to tightening the second body post cap fastener or with the second body post cap fastener attached via an adjustable second body post cap fastener location providing adjustment for positioning the second body post cap relative to the second end of the body slide prior to tightening the second body post cap fastener.

2. The body mount system of claim 1 wherein the adjustable body slide fastener location comprises a body slide elongated opening in a first horizontal direction perpendicular to the body slide.

3. The body mount system of claim 1 wherein the fixed first body post cap fastener location comprises a first body slide bore provided in the first end of the body slide.

4. The body mount system of claim 1 wherein the adjustable first body post cap fastener location comprises a body slide elongated opening in a second horizontal direction longitudinal to the body slide.

5. The body mount system of claim 4 wherein the first body post cap is adjustable within a range of motion of the first body post cap fastener within the corresponding body slide elongated opening, prior to tightening of the first body post cap fastener.

6. The body mount system of claim 1, further comprising;

a first body post cap retainer provided in the first body post cap a first cap retainer pocket provided in the body post; and wherein the first body post cap retainer is engaged with the first cap retainer pocket when the first body post cap fasteners are attached via the fixed first body post cap fastener location.

7. The body mount system of claim 1, further comprising:

a first body support pivotally coupled with the first body post cap; and a second body support pivotally coupled with the second body post cap.

8. The body mount system of claim 1, wherein the body post is coupled to a front of a model vehicle platform or a rear of a model vehicle platform via a body mount retainer.

9. A body mount system for a model vehicle comprising:

a body post attached to a model vehicle platform at a desired vertical height;

a body slide comprising:

a first and second body slide bores; and a first and second body slide elongated openings in a first horizontal direction perpendicular to the body slide;

a first and second body slide fastener coupling the body slide to the body post;

wherein the body slide is coupled to the body post via the first and the second body slide bores or via the first and second body slide elongated openings;

wherein the body slide is fixed in position relative to the body post when the first and second body slide bores are used prior to tightening the first and second body slide fasteners; and wherein the body slide is adjustable in position relative to the body post within a range of motion of the first and second body slide fasteners within the corresponding first and second body slide elongated openings prior to tightening the first and second body slide fasteners.

10. The body mount system according to claim 9, further comprising:

a first body post cap attached to a first body slide end using a first body post cap fastener; and a second body post cap attached to a second body slide end using a second body post cap fastener.

11. The body mount system according to claim 10, wherein the first body post cap is adjustable relative to the body slide within an extent defined by movement of the first body post cap fastener in a first body post cap elongated opening provided in the first body slide end, prior to tightening of the first body post cap fastener.

12. The body mount system according to claim 10, wherein the first body cap is fixed in position relative to the body slide when the first body post cap fastener attaches the first body post cap to the first body slide end via a first body post cap bore provided in the first end of the first end of the body slide.

13. The body mount system according to claim 9, wherein the body post mounts to the model vehicle platform via a body mount retainer.

* * * * *